US006091396A

United States Patent [19]

Minami et al.

[11] Patent Number: 6,091,396

[45] Date of Patent: Jul. 18, 2000

[54] DISPLAY APPARATUS AND METHOD FOR REDUCING DYNAMIC FALSE CONTOURS

[75] Inventors: Kouji Minami; Yoshito Suzuki, both of Tokyo, Japan

[73] Assignee: Mitsubishi Denki Kabushiki Kaisha, Tokyo, Japan

[21] Appl. No.: 08/946,099

[22] Filed: Oct. 7, 1997

[30] Foreign Application Priority Data

Oct. 14, 1996 [JP] Japan ..... 8-270869

[51] Int. Cl.[7] ..... G09G 5/10

[52] U.S. Cl. ..... 345/147; 345/149

[58] Field of Search ..... 345/147, 148, 345/149, 150, 153, 155

[56] References Cited

U.S. PATENT DOCUMENTS

| | | | |
|---|---|---|---|
| 5,187,578 | 2/1993 | Kohgami et al. | 345/148 |
| 5,317,334 | 5/1994 | Sano | 345/148 |
| 5,856,823 | 1/1999 | Kimoto et al. | 345/155 |

FOREIGN PATENT DOCUMENTS

| | | |
|---|---|---|
| 0698874A1 | 2/1996 | European Pat. Off. . |
| 0720139A2 | 7/1996 | European Pat. Off. . |
| 074745A2 | 5/1997 | European Pat. Off. . |
| 138692 | 6/1991 | Japan . |
| 4-211294 | 8/1992 | Japan . |
| 7140922 | 6/1995 | Japan . |
| 863122 | 3/1996 | Japan . |

*Primary Examiner*—Vijay Shankar

[57] ABSTRACT

A display apparatus has code conversion assembly for converting a video signal into a coded signal comprised of a plurality of bits, each indicating a combination of luminescence and non-luminescence in the plurality of sub-fields. The plurality of sub-fields includes at least one sub-field having a relative ratio of luminescent time which deviates from a power series of 2. The plurality of sub-fields having a high relative ratio of luminescent time are arranged in a time sequence in a descending or ascending order. The relative ratio of luminescent time includes at least the highest, the second highest and the third highest relative ratios of luminescent time. When an up-shift occurs in a circumstance that at a gray level of n, a first sub-field having the high relative ratio of luminescent time is lit on while a second sub-field having a next higher relative ratio of luminescent time than the first sub-field is lit off, and at a gray level of n+1, the second sub-field is lit on, the first sub-field is caused to be lit off at the gray level of n+1.

7 Claims, 19 Drawing Sheets

DISPLAY CONDITION (1)

NON-DISPLAY CONDITION (0)

DISPLAY CONDITION (1)

NON-DISPLAY CONDITION (0)

DISPLAY APPARATUS AND METHOD FOR REDUCING DYNAMIC FALSE CONTOURS

BACKGROUND OF THE INVENTION

The present invention relates to a display apparatus such as a plasma display panel (PDP) system or a digital micro-mirror device (DMD), and more particularly, to a display apparatus in which one television field is divided into a plurality of sub-fields to get a variety of gray scale intensity.

Among flat panel displays, a PDP system is the easiest to construct into a larger size and exhibits excellent fundamental performances such as response time, color reproducibility or the like, and is expected to be the most promising candidate for a wall-mounted television set.

In the known PDP system, a period for one field is divided into a plurality of sub-fields, each of which is allocated a relative ratio of display time (i.e., luminescence time), which is chosen to be a power series of 2 such as 1:2:4:8: . . . so that a combination of luminescence and non-luminescence for the respective sub-fields provides a gradation display of each picture element.

FIG. 20 shows an example of luminescence sequence during one field. This figure shows the example in which one field is divided into eight sub-fields SF0 to SF7. A relative ratio of luminescence time of the respective sub-fields is chosen to be in the ratio of 1:2:4:8:16:32:64:128, and the combination of luminescence and non-luminescence of the individual sub-fields is capable of representing 256 gray levels.

For example, when a gray level of 127 is to be provided, the sub-fields SF0 to SF6 are in on-state while the sub-field SF7 is in off-state. A human eye has a time integrating effect and does not respond to on/off of luminescence within one field. Thus, the luminescence from the sub-fields SF0 to SF6 are integrated by a human eye, providing a perception as if a gray level of 127 has been given.

When a video signal is to be displayed by the display apparatus, the video signal is initially converted into an 8-bit digital signal. The least significant bit b0 is assigned to a sub-field SF0, the second least significant bit b1 to a sub-field SF1, the third least significant bit b2 to a sub-field SF2, . . . , and finally the most significant bit b7 is assigned to a sub-field SF7.

FIG. 21 is a block diagram showing a prior art display apparatus which implements a gradation display. As shown in FIG. 21, the display apparatus has an input terminal 1 to which a video signal is input; an input terminal 2 to which sync signals are input; an A/D converter 3 in which the video signal input to the input terminal 1 is converted into a digital signal; a field memory 4 which stores two fields of output signal from the A/D converter 3; a driver 5 which drives a PDP 7 in accordance with output signals from the field memory 4; the controller 6, which controls the A/D converter 3, the field memory 4 and the driver 5 on the basis of the sync signals; and the PDP 7.

Next, the operation will be described. The video signal which is supplied from the input terminal 1 is converted into an 8-bit digital signal in the A/D converter 3, and two fields of digital signal are stored in the field memory 4. The field memory 4 includes a pair of field memory sections, and input signal is alternately written into the first field memory section and the second field memory section.

Next, during an address period of the sub-field SF0 shown in FIG. 20, the controller 6 controls the field memory 4 so that the data for a bit b0 is read from the field memory 4. At this time, the data is read out of either memory section to which a write operation is not being made. Data read is passed through the driver 5 to be written into the PDP 7. For an AC plasma display, the panel has an inherent memory which allows written data to be maintained during a period required for data for the whole screen to be written into the PDP 7. During a subsequent sustain period, the controller 6 controls the driver 5 so that luminescence from the PDP 7 occurs only from a picture element for which data for the bit b0 is set to be in on-state.

During a subsequent address period of the sub-field SF1, data for a bit b1 is read from the field memory 4 and fed through the driver 5 to the PDP 7. During a subsequent sustain period of the sub-field SF1, luminescence occurs for a period which is twice as long as the sustain period of the sub-field SF0.

Similarly, during the sub-fields SF2 to SF7, the corresponding bits b2 to b7 are read from the field memory 4 during the respective address periods and fed through the driver 5 to the PDP 7, allowing luminescence during the respective following sustain period for respective periods which are 4, 8, . . . , 128 times longer than the luminescence time in the sub-field SF0.

In the display apparatus which provides a gradation display in the manner mentioned above, it occurs that when a flat image which varies smoothly in the horizontal direction moves horizontally across the screen, a vertical strip-shaped band which was invisible when the image was at rest appears to be perceived, such band being hereafter referred to as a dynamic false contour. Similarly, when a flat image which smoothly varies in the vertical direction moves vertically across the screen, a dynamic false contour is again perceived. This phenomenon will be further described with reference to FIG. 22 and FIG. 23.

FIG. 22 illustrates that an image which varies smoothly in the horizontal direction, namely an image having a gray level which changes from 127 to 128, is moving to the left at the rate of two picture elements per field.

When representing a gray level of 127, luminescence occurs for seven sub-fields including SF0 to SF6, and when representing a gray level of 128, the luminescence occurs only for the sub-field SF7. When such an image is viewed by a human being, the line of vision is roughly indicated by broken lines $R_0$, $R_1$ and $R_2$. A position on the retina which corresponds to a region to the left of the broken line $R_0$ will perceive a gray level of 127, while a position on the retina which corresponds to a region located to the right of the broken line $R_2$ will perceive a gray level of 128. However, a position on the retina which corresponds to the broken line $R_1$ will perceive substantially null, which is perceived as the false contour. FIG. 23 is a diagram showing a relationship between relative perception quantity of brightness and a position on the retina.

There is a tendency that such a phenomenon is readily perceivable upon movement of an image containing a change from the gray level of 127 in which seven sub-fields SF0 to SF6 are turned on to the gray level of 128 in which the luminescence occurs only during the sub-field SF7, namely, an image having an up-shift from a lower significant bit to the most significant bit, or a down-shift from the most significant bit to the lower significant bit. This is attributable to two points described below.

1) Between the adjacent gray levels, there is a significant barycenter shift in the luminescence time within one field. Namely, for the gray level of 127, the luminescence occurs early within one field in a concentrated manner, while for the gray level of 128, the luminescence occurs late within one field in a concentrated manner.

2) Between the adjacent gray levels, the magnitude of change in the amount of luminescence from non-luminescence to luminescence or from luminescence to non-luminescence is large. Specifically, sub-fields, which are turned on at a gray level of 127, is turned off at the gray level of 128, while the sub-field, which is turned off at a gray level of 127, is turned on at the gray level of 128.

FIG. 24 is a diagram showing a gradation display method used for a prior art display apparatus as disclosed in Japanese Patent Kokai Publication No.211,294/1992. Specifically, a sub-field which corresponds to the most significant bit b7 is evenly divided into sub-fields SF7-1 and SF7-2, placing the luminescence time regions at both the beginning and the end of one field.

By using such a luminescence sequence, the perception quantity of a false contour can be reduced. This will be described with reference to FIG. 25 and FIG. 26.

FIG. 25 illustrates a case in which an image, having a change of the gray level from 127 to 128 in the same way as FIG. 22, moves to the left at the rate of two picture elements per field. At the gray level of 127, seven sub-fields SF0 to SF6 are turned on, while at the gray level of 128, only sub-fields SF7-1 and SF7-2 are turned on.

When such an image is viewed by a human being, the line of vision is roughly indicated by broken lines $R_0$, $R_1$, $R_2$ and $R_3$. A position on the retina which corresponds to a region located to the left of the broken line $R_0$ will perceive a gray level of 127, while a position on the retina which corresponds to a region located to the right of the broken line $R_3$ will perceive a gray level of 128. Further, a position on the retina which corresponds to the broken line $R_1$ will perceive a gray level of about 191, and a position corresponding to the broken line $R_2$ will perceive a gray level of about 64. A relationship between the relative perception quantity of brightness and the position on the retina is shown in FIG. 26. It will be apparent that an improvement is achieved over the example described above.

Although it will be apparent that such the prior art display apparatus (shown in FIG. 24 and FIG. 25) is constructed in the above described manner and is improved over the above example shown in FIG. 20 and FIG. 21, such improvement is insufficient for use with actual images.

This is because while a barycenter shift in the luminescence time between the adjacent gray levels is reduced, the magnitude of change in the amount of luminescence which occurs between luminescence and non-luminescence across the adjacent gray levels remain to be large in the same manner as the above described example (FIG. 20 and FIG. 21), thereby reducing the improvement.

As indicated above, there is a problem that a false contour which is invisible when the image is at rest becomes perceivable when a flat image which varies smoothly moves across the screen.

SUMMARY OF THE INVENTION

It is an object of the present invention to overcome the problem mentioned above by providing a display apparatus which is capable of providing a gradation display while reducing a dynamic false contour.

According to the present invention, a display apparatus has code conversion assembly for converting a video signal into a coded signal comprised of a plurality of bits each indicating a combination of luminescence and non-luminescence in the plurality of sub-fields. The plurality of sub-fields includes at least one sub-field having a relative ratio of luminescent time which deviates from a power series of 2. The plurality of sub-fields having a high relative ratio of luminescent time are arranged in a time sequence in a descending or ascending order. The relative ratio of luminescent time includes at least the highest, the second highest and the third highest relative ratios of luminescent time. When an up-shift occurs in a circumstance that at a gray level of n, a first sub-field having the high relative ratio of luminescent time is turned on while a second sub-field having a next higher relative ratio of luminescent time than the first sub-field is turned off, and at a gray level of n+1, the second sub-field is turned on, the first sub-field is caused to be turned off at the gray level of n+1.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Further scope of applicability of the present invention will become apparent from the detailed description given hereinafter. However, it should be understood that the detailed description and specific examples, while indicating preferred embodiments of the invention, are given by way of illustration only, since various changes and modifications will become apparent to those skilled in the art from the detailed description.

First Embodiment

Figure 1:
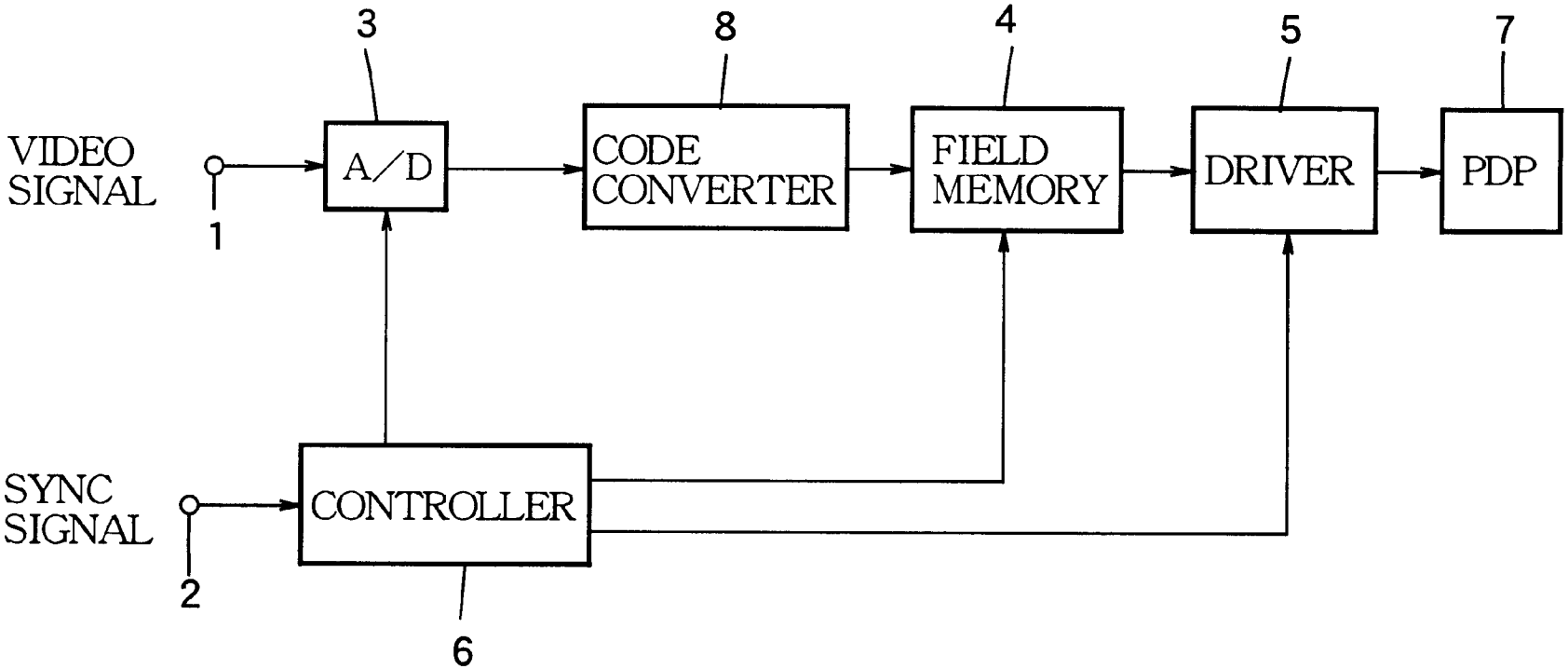
FIG. 1 is a block diagram showing the configuration of a display apparatus according to a first embodiment of the present invention.
Figure 21:
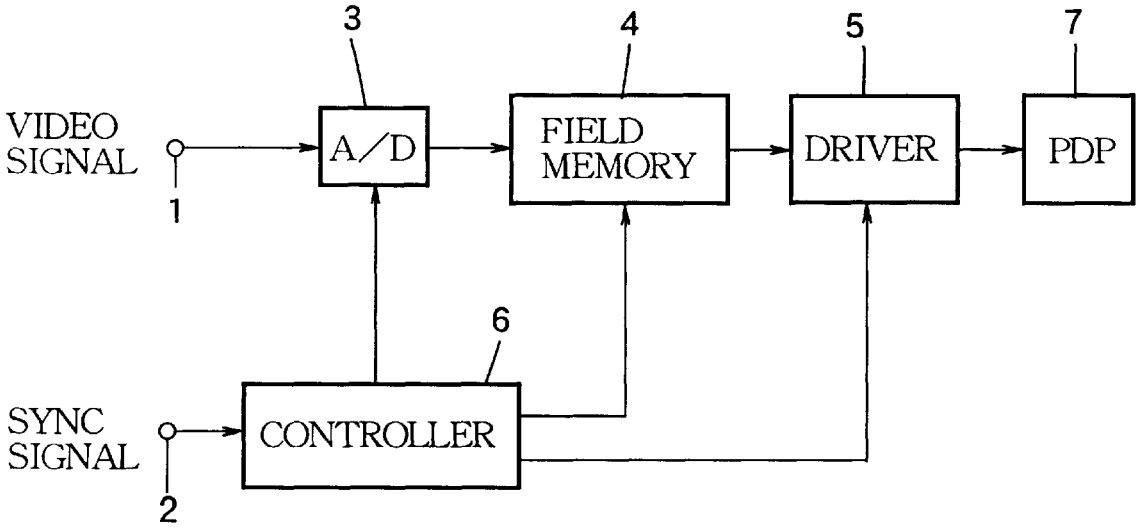
FIG.21 PRIOR ART
FIG. 21 is a block diagram showing the configuration of the prior art display apparatus.
Figure 22:
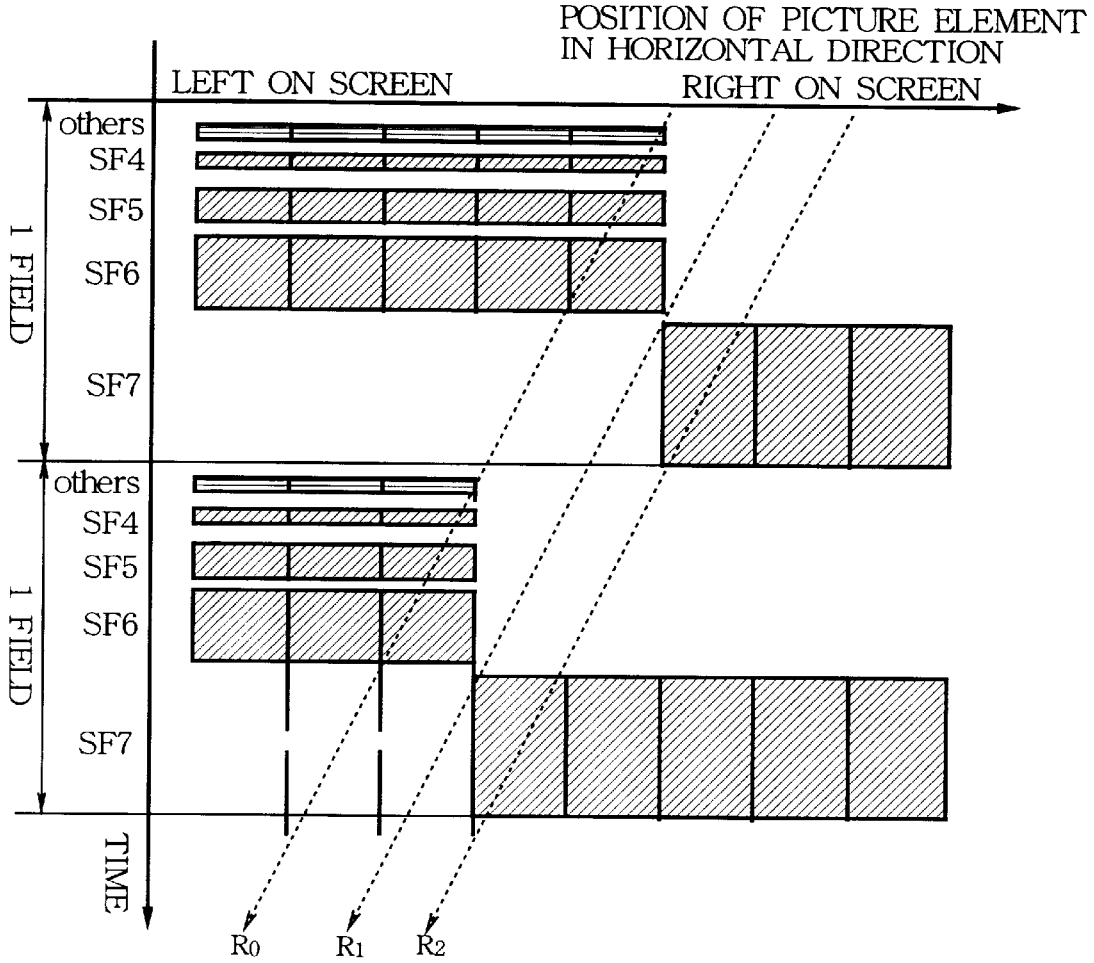
FIG.22 PRIOR ART
FIG. 22 is a diagram for explaining a phenomenon of a dynamic false contour when the prior art display apparatus is used.
Figure 23:
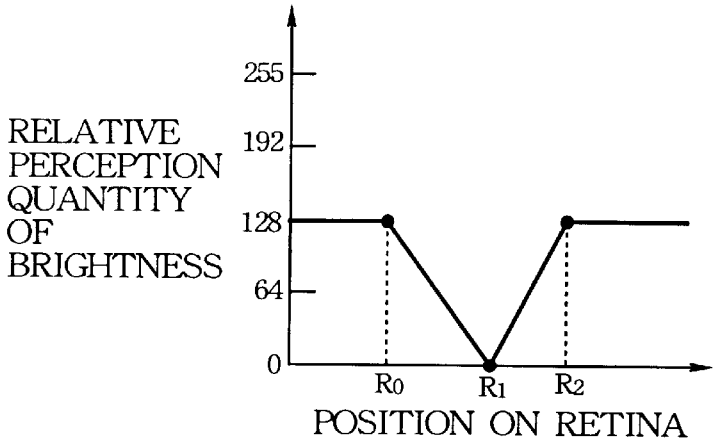
FIG.23 PRIOR ART
FIG. 23 is a diagram for explaining the perception quantity of the dynamic false contour when the prior art display apparatus is used.
Figure 24:
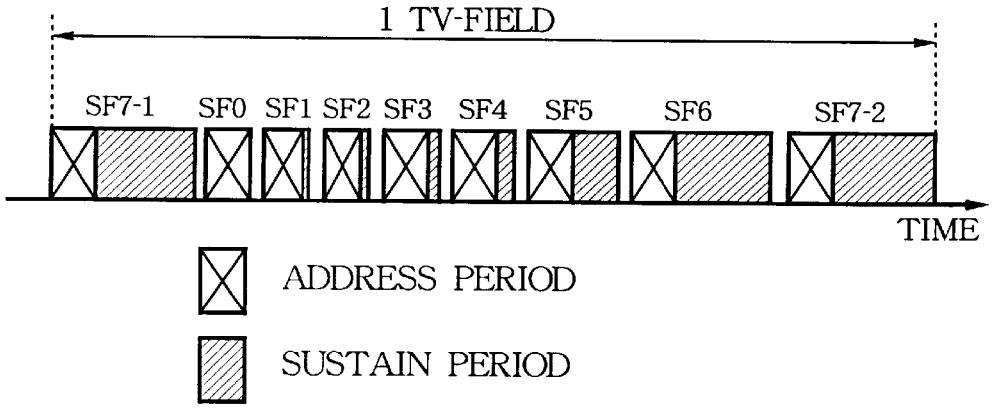
FIG.24 PRIOR ART
FIG. 24 is a diagram showing a luminescence sequence for explaining another prior art display apparatus.
Figure 25:
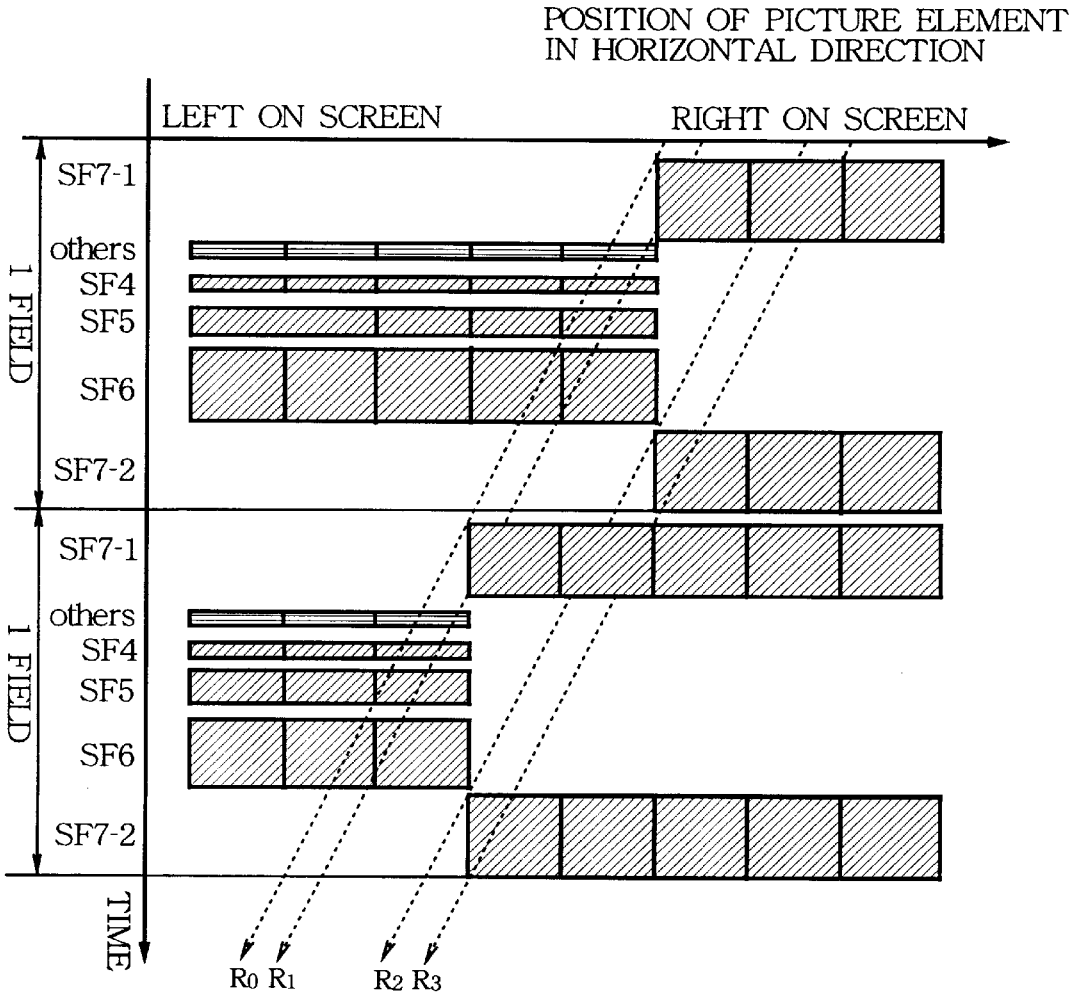
FIG.25 PRIOR ART
FIG. 25 is a diagram for explaining a phenomenon of a dynamic false contour when the display apparatus shown in FIG. 24 is used.
Figure 26:
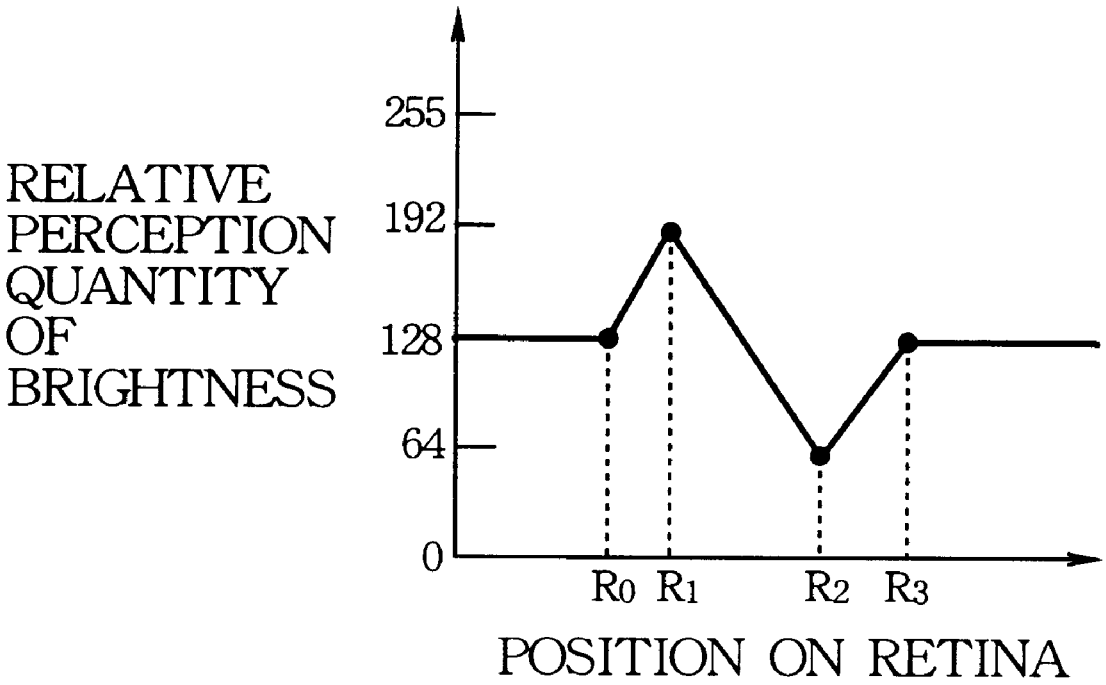
FIG.26 PRIOR ART
FIG. 26 is a diagram for explaining the perception quantity of a dynamic false contour when the prior art display apparatus is used.

FIG. 1 is a block diagram showing the configuration of a display apparatus according to a first embodiment of the present invention, which realizes a gradation display method. Those structures in the figures used for the display apparatus of the first embodiment that are identical or corresponding to structures in the above-mentioned display apparatus shown in FIG. 21 are assigned identical symbols.

As shown in FIG. 1, a video signal is input to an input terminal 1, while sync signals are input to another input terminal 2. The video signal applied to the input terminal 1 is converted into a digital signal by an A/D converter 3, the output of which is again converted into a coded signal by a code converter 8. The coded signal from the code converter 8 which corresponds to two fields is stored in a field memory 4. A driver 5 is fed with coded signal read from the field memory 4, and is controlled by an output signal from a controller 6, which operates to control the A/D converter 3, the field memory 4 and a PDP 7 on the basis of the sync signals.

The operation of the display apparatus having the above mentioned configuration will be described below.

Figure 2:
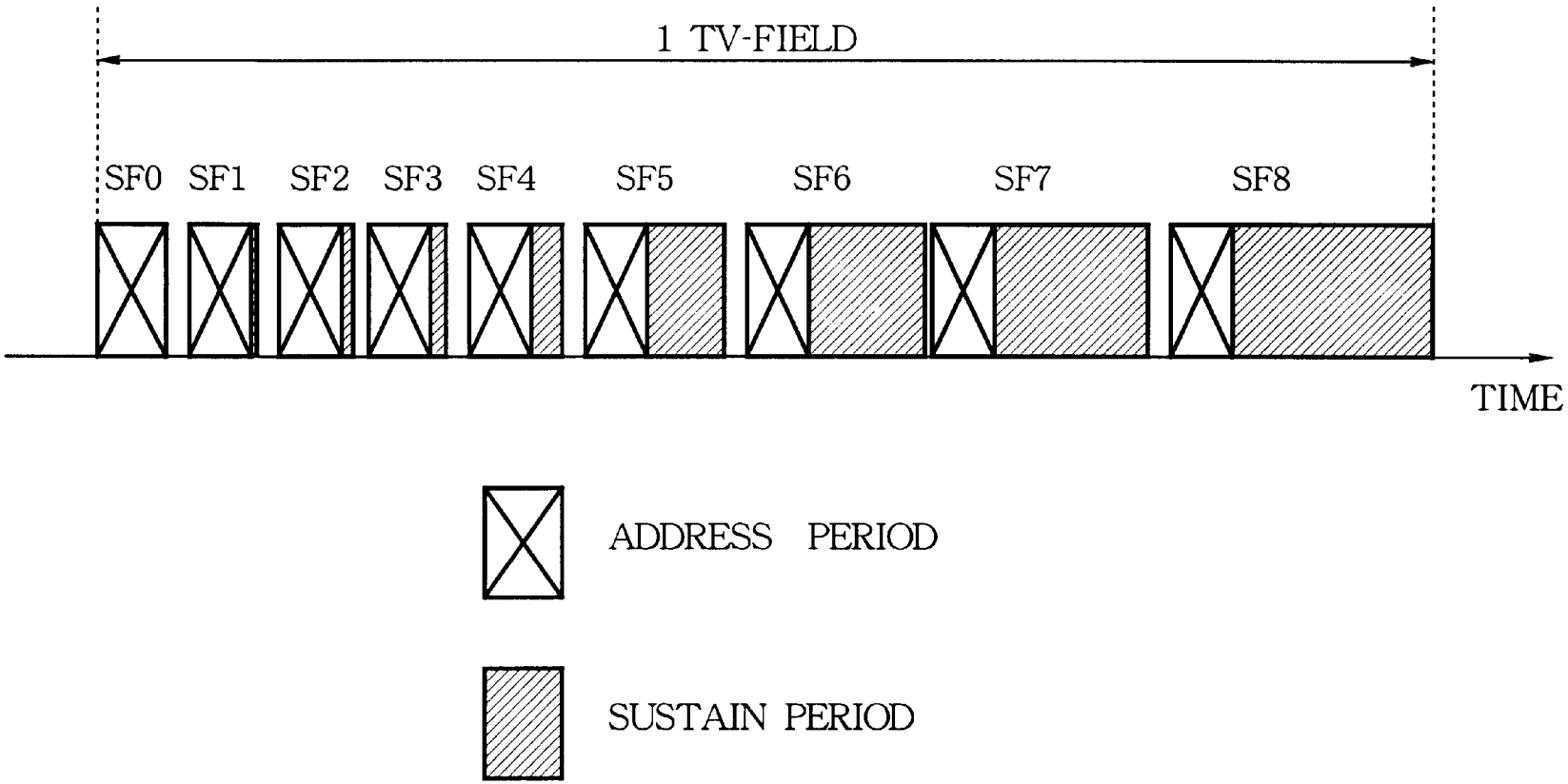
FIG. 2 is a diagram showing a luminescence sequence which illustrates an operation of the display apparatus according to the first embodiment of the present invention.

FIG. 2 is a diagram showing a luminescence sequence of one field period in a gradation display method used with the display apparatus. In the example of the luminescence sequence shown in the figure, one field is divided into nine sub-fields SF0 to SF8.

A relative ratio of luminescence time (a relative ratio of brightness orbit weights bb0 to bb8 described below) for the individual sub-fields SF0 to SF8 are chosen to be 1:2:4:8:16:32:48:64:80 in the sequence from the sub-fields SF0 to SF8. A combination of luminescence and non-luminescence for these sub-fields SF0 to SF8 is capable of providing 256 gray scale intensity.

The input video signal is converted into 8-bit digital signal containing bits b0 to b7 by the A/D converter 3, and is then converted into 9-bit digital data containing bits bb0 to bb8 by the code converter 8. The field memory 4 stores two fields of the converted 9-bit digital data. The field memory 4 includes a first field memory section and a second field memory section, into which an input signal is alternately written every field.

During an address period of the sub-field SF0 shown in FIG. 2, the controller 6 controls the field memory 4 so that data for the bit bb0 is read from the field memory 4. A read-out from the field memory 4 takes place from one of the field memory sections to which no write operation is being made.

Data read is fed through the driver 5 to be written into the PDP 7. As mentioned previously, an AC plasma display has an inherent memory in the panel, and accordingly, data which is written into it is maintained during a period required for data for the whole screen to be sequentially written into the PDP 7. During a sustain period which follows the address period, the controller 6 controls the driver 5 so that the PDP 7 effects luminescence for only a picture element or picture elements for which data for the bit bb0 represents the on-state.

During a next address period corresponding to the sub-field SF1, data for the bit bb1 is read from the field memory 4, and fed through the driver 5 to be supplied to the PDP 7. During a sustain period which follows, the luminescence takes place for a period which is twice as long as the luminescence time used for the sub-field SF0.

Similarly, bits bb2 to bb8 are read from the field memory 4 during address periods associated with the sub-fields SF2 to SF8, and are fed through the driver 5 to be supplied to the PDP 7. During the respective sustain periods which follow the respective address periods, the luminescence occurs for the sub-fields SF2 to SF8 for time intervals which are 4, 8, 16, 32, 48, 64 and 80 times, respectively, as long as the luminescence time used with the sub-field SF0.

Next, the code converter 8 will be described in detail.

In the prior art apparatus, each of bits b0 to b7 in the digital data which is obtained from the A/D converter 3 has a weight which is generally in the ratio of power series of 2, namely, in the ratio of 1:2:4:8:16:32:64:128. When the relative ratio of brightness for the sub-fields SF0 to SF7 is in the same ratio as mentioned above, as occurs in the prior art luminescence sequence, each bit b0 to b7 of the digital data may be assigned to SF0 to SF7, respectively. Thus, luminescence may occur during the sub-field SF0 for a picture element having b0 which is equal to 1, and the luminescence may occur during the sub-field SF1 for a picture element having b1 which is equal to 1.

However, when the relative ratio of brightness for a given luminescence sequence includes a member or members which deviate from a power series of 2, as exemplified by the sequence SF0 to SF8 having the ratio of 1:2:4:8:16:32:48:64:80 as shown in FIG. 2 (where the deviating members are 48 and 80), the digital data b0 to b7 which is obtained from the A/D converter 3 must be converted to the digital data bb0 to bb8 having bit weights in the ratio of 1:2:4:8:16:32:48:64:80.

For example, when the digital data from the A/D converter 3 represents a gray level of 64, (b7, b6, b5, b4, b3, b2, b1, b0)=(0, 1, 0, 0, 0, 0, 0, 0), and thus this must be converted into (bb8, bb7, bb6, bb5, bb4, bb3, bb2, bb1, bb0)=(0, 0, 1, 0, 1, 0, 0, 0, 0). For a gray level of 128, there is a need of code conversion from (b7, b6, b5, b4, b3, b2, b1, b0)=(1, 0, 0, 0, 0, 0, 0, 0) to (bb8, bb7, bb6, bb5, bb4, bb3, bb2, bb1, bb0)=(0, 1, 1, 0, 0, 1, 0, 0, 0).

It is the function of the code converter 8 to perform such conversions for gray levels from 0 to 255.

When 8-bit digital data is employed in a normal code which comprises a power series of 2, there exists only one code which represents a particular gray level. Thus, there is only one code (b7, b6, b5, b4, b3, b2, b1, b0)=(0, 1, 0, 0, 0, 0, 0, 0) which represents a gray level of 64. Similarly, there is only one code (b7, b6, b5, b4, b3, b2, b1, b0)=(1, 0, 0, 0, 0, 0, 0, 0) which represents a gray level of 128, and there is no other code which represents this gray level.

However, when one more bit is added, and a code including bb8 to bb0 is employed which includes a bit or bits having a weight which deviate from a power series of 2, there is a plurality of codes which represents a particular gray level. For example, there are two codes which represent a gray level of 64; (bb8, bb7, bb6, bb5, bb4, bb3, bb2, bb1, bb0)=(0, 0, 1, 0, 1, 0, 0, 0, 0) and (0, 1, 0, 0, 0, 0, 0, 0, 0), and there are three codes which represent a gray level of 128; (bb8, bb7, bb6, bb5, bb4, bb3, bb2, bb1, bb0)=(0, 1, 1, 0, 1, 0, 0, 0, 0), (1, 0, 1, 0, 0, 0, 0, 0, 0) and (1, 0, 0, 1, 1, 0, 0, 0, 0).

Accordingly, if there are a plurality of codes which represents a particular gray level, the code converter 8 selects a suitable one of these codes. For each of gray levels from a minimum level (which is equal to 0 in this embodiment) to a maximum level (which is equal to 255 in this embodiment), a suitable one code is selected, and a combination of codes selected in this manner is hereafter referred to as a series.

Figure 3:
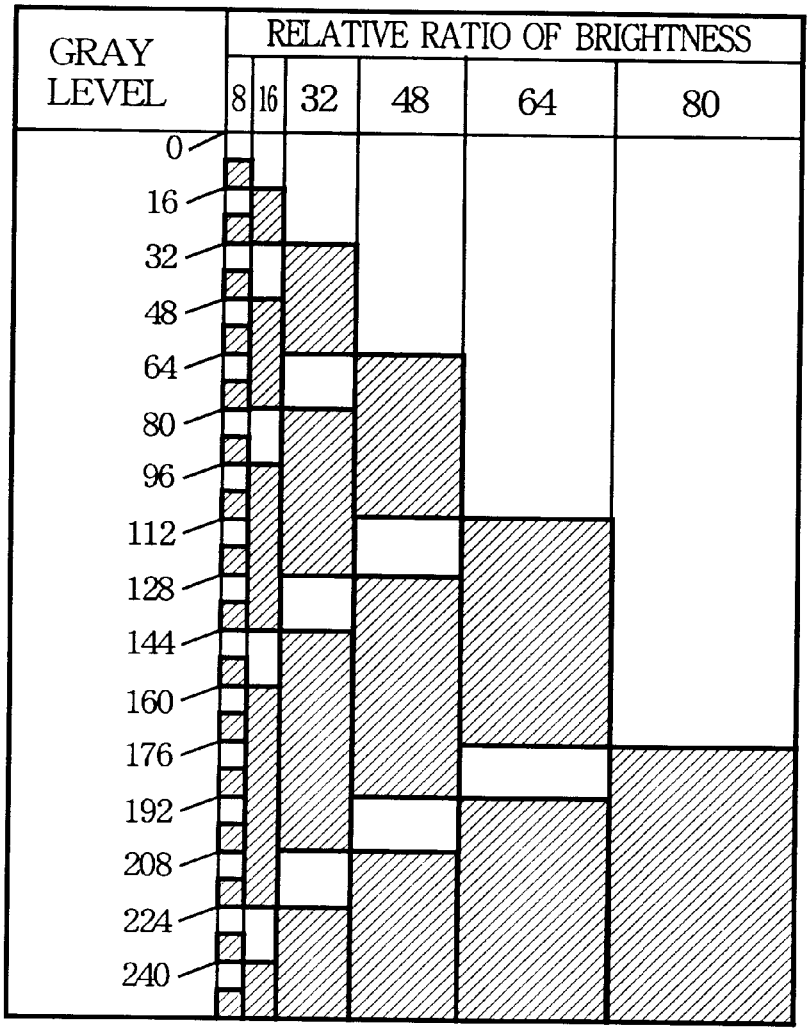
FIG. 3 is a diagram showing an exemplary series which complies with an up-shift rule described in connection with the first embodiment of the present invention.

FIG. 3 is a diagram showing an example of a series. A region which is hatched indicates a display condition (1), and a region which is not hatched indicates a non-display condition (0). To facilitate understanding each bit weight (i.e., a relative ratio of brightness), corresponds to the width of each column (i.e., the hatched region or unhatched region). The bits having a significance equal to or less than 4 are not shown in FIG. 3, since no conversion takes place for those bits.

The series is constructed according to the following rule.

When an up-shift occurs in a circumstance that at a gray level of n (where n is an integer and $0 \leqq n \leqq 254$), a bit bbx having a bit weight greater than a relatively high weight (which is equal to 32 in this embodiment shown in FIG. 3) is equal to 1 and a bit bby which has a next higher significance than the bit bbx is equal to 0 and at a gray level of n+1, the bit bby is equal to 1, the bit bbx for the gray level of n+1 is made equal to 0. This will be hereafter referred to as an up-shift rule.

A bit or bits having a relatively low weight or weights have no influence upon the occurrence of a dynamic false contour, and therefore, they are not required to comply with the up-shift rule.

The display apparatus according to the first embodiment of the present invention which provides a gradation display according to the scheme mentioned above has the effect of reducing perception quantity of a dynamic false contour. This effect will be described below with reference to FIG. 4 and FIG. 5.

Figure 4:
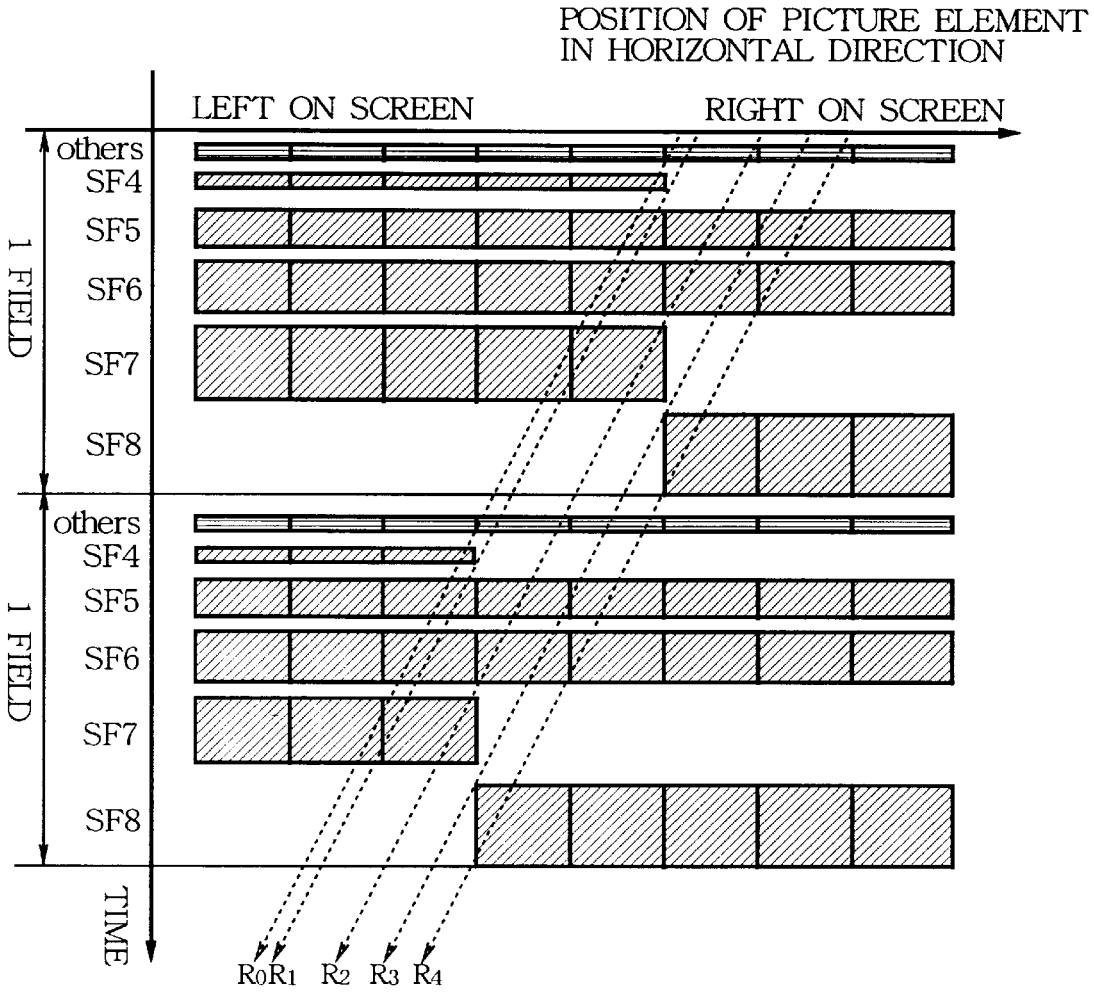
FIG. 4 is a diagram for explaining a phenomenon referred to as a dynamic false contour which would occur when the series shown in FIG. 3 is used.

FIG. 4 is a diagram showing that an image which varies smoothly in the horizontal direction, namely an image in which the gray level changes from 175 to 176 is moving to the left at the rate of two picture elements per field.

In an area representing the gray level of 175, a sub-field SF8 which has the highest relative ratio of brightness is in the non-display condition (unhatched area in FIG. 4), while in an area representing the gray level of 176, the same sub-field SF8 is in the display condition (hatched area in FIG. 4), thus a condition in which an up-shift to the most significant bit occurs. When such an image is viewed by a human being, the line of vision is roughly placed on the lines $R_0$, $R_1$, $R_2$, $R_3$ and $R_4$. A position on the retina which corresponds to a region located to the left of the broken lines $R_0$ will perceive a gray level of 175 while a position on the retina which corresponds to a region located to the right of the broken lines $R_4$ will perceive a gray level of 176. Intermediate positions on the retina which correspond to the broken lines $R_1$, $R_2$ and $R_3$ have perceptions illustrated in FIG. 5, which graphically indicates a relationship between the relative perception quantity of brightness and a position on the retina. It will be seen that the perceived intensity of a dynamic false contour is reduced as compared with the prior art.

This is in consequence of the application that the series includes sub-fields having relative ratios of 48 and 80 which deviate from a power series of 2, the plurality of sub-fields having a high relative ratio of luminescent time are arranged in a time sequence in an ascending order (however, a descending order may also be selected), and the series according to the up-shift rule is used. As such the application brings forth the following improvements.

1) A shift in the barycenter in time of the luminescence during one field is relatively small between adjacent gray levels.
2) The magnitude of change in the amount of luminescence from non-luminescence to luminescence or from luminescence to non-luminescence is relatively small between adjacent gray levels. For example, between gray levels of 175 and 176, sub-fields having relative ratios of 1, 2, 4, 8 and 64 totaling 79 change from luminescence to non-luminescence while a sub-field of 80 changes from non-luminescence to luminescence.

As described above, in the display apparatus according to the first embodiment, the plurality of sub-fields includes at least one sub-field having a relative ratio of luminescent time which deviates from a power series of 2, the plurality of sub-fields having a high relative ratio of luminescent time are arranged in a time sequence in a descending or ascending order, and the up-shift rule is applied. This reduces a shift in the barycenter in time of the luminescence within the field between closely located gray levels, and also reduces the magnitude of change in the amount of luminescence from non-luminescence to luminescence or from luminescence to non-luminescence is relatively small between adjacent gray levels, thereby reducing perception of the dynamic false contour.

Figure 6:
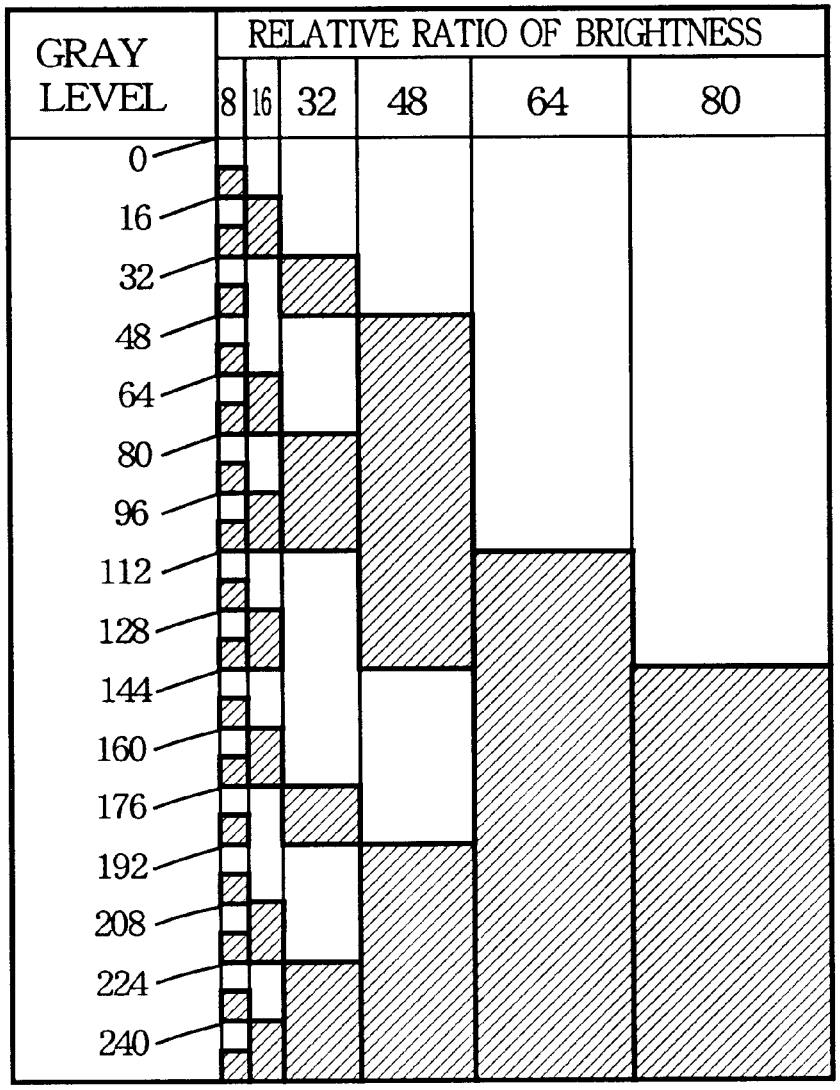
FIG.6 CONVENTIONAL ART
FIG. 6 is a diagram showing a conventional example of a series which does not comply with an up-shift rule described in connection with the first embodiment of the present invention.

It is to be noted that when the series does not comply with the up-shift rule, the effect of reducing the false contour will be reduced. By way of example, FIG. 6 shows an example of series which does not comply with the up-shift rule.

Specifically, in this instance, for a gray level of n (where $0 \leqq n \leqq 254$), a bit bbx having a bit weight greater than a relatively high weight (which is equal to 32 in the example shown in FIG. 6) is equal to 1 and the bit bby having a next higher weight than the bit bbx is equal to 0, and for a gray level of n+1, a bit bby is equal to 1, thus producing an up-shift for the bit, as specified by the up-shift rule. However, the bit bbx for the gray level of n+1 chosen is equal to 1.

A resulting dynamic false contour in the display apparatus which utilizes such series to provide a gradation display will be described with reference to FIG. 7 and FIG. 8.

Figure 7:
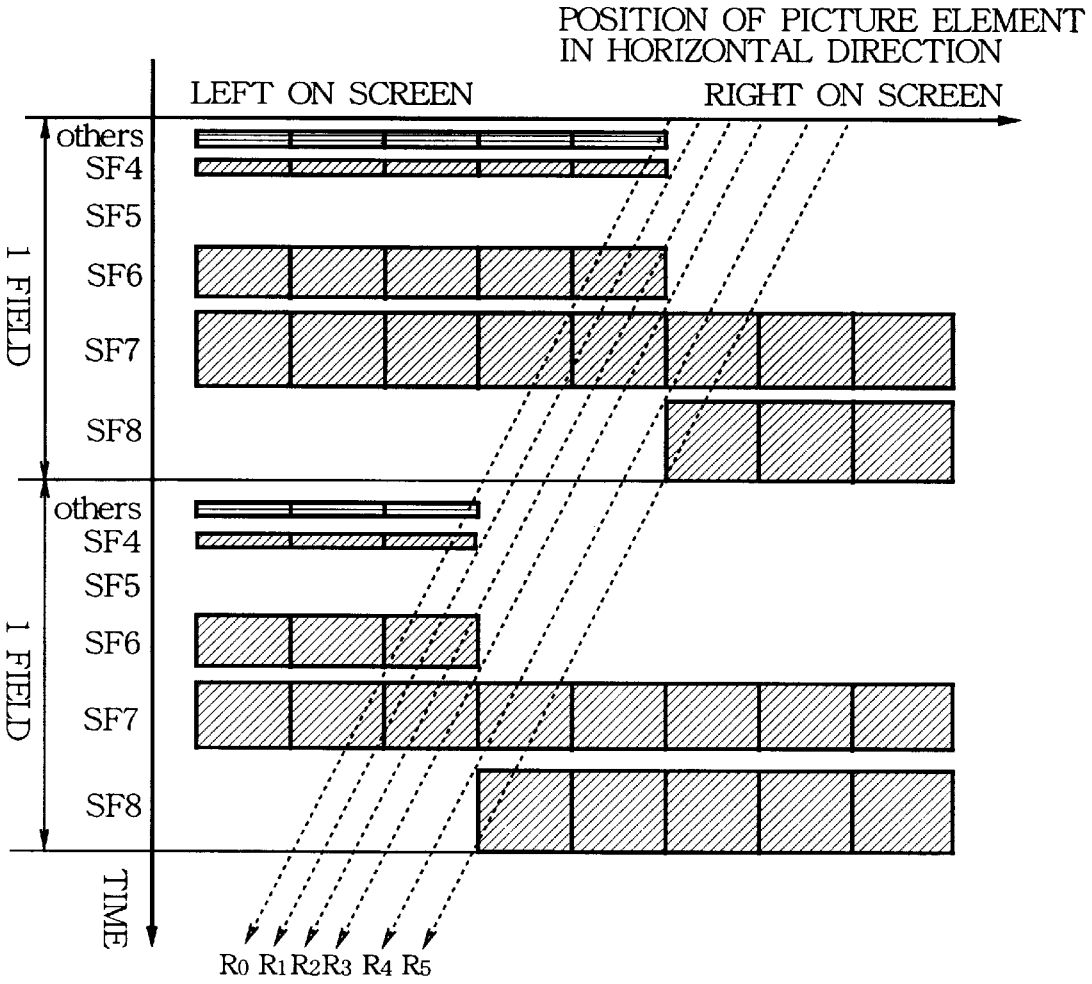
FIG.7 CONVENTIONAL ART
FIG. 7 is a diagram for explaining a phenomenon of a dynamic false contour when the series of the conventional example shown in FIG. 6 is used.
Figure 8:
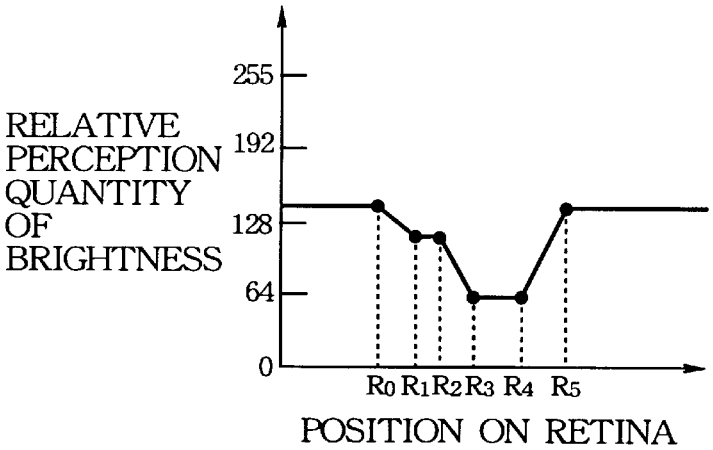
FIG.8 CONVENTIONAL ART
FIG. 8 is a diagram for explaining a perception quantity of the dynamic false contour when the series of the conventional example shown in FIG. 6 is used.

FIG. 7 illustrates that an image having a gray level which changes from 143 to 144 is moving to the left at the rate of two picture elements per field.

Figure 5:
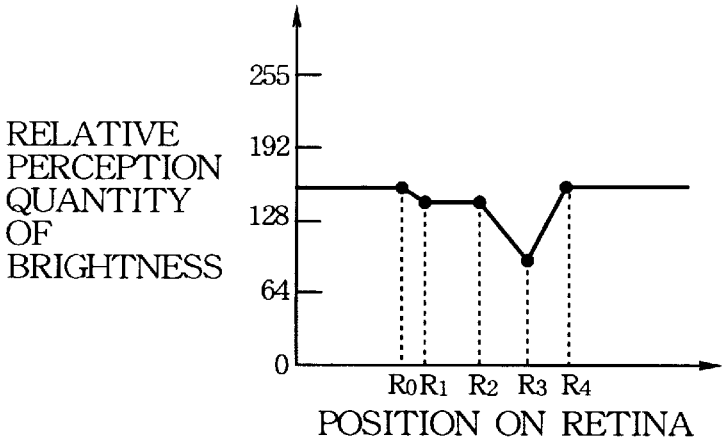
FIG. 5 is a diagram for explaining the effect of reducing a dynamic false contour when the series shown in FIG. 3 is used.

In an area representing the gray level of 143, a sub-field SF8 having the highest relative ratio of brightness is in the non-display condition while in an area representing the gray level of 144, the same sub-field SF8 is in the display condition, thus producing an up-shift to the most significant bit. When this image is viewed by a human being, the line of vision will be roughly placed on the broken lines $R_0$, $R_1$, $R_2$, $R_3$, $R_4$ and $R_5$. A position on the retina which corresponds to a region located to the left of the broken line $R_0$ will perceive a gray level of 143, while a position on the retina which corresponds to a region located to the right of the broken line $R_5$ will perceive a gray level of 144. Intermediate positions on the retina which correspond to the broken lines $R_1$, $R_2$, $R_3$ and $R_4$ have perception as indicated graphically in FIG. 8. It will be obvious that the effect of reducing the false contour (FIG. 8) is reduced as compared with an arrangement in which the series complying with the up-shift rule is used (FIG. 5).

This is a result of a greater shift in the barycenter in time of the luminescence between adjacent gray levels.

Second Embodiment

While a single series is used in the above-mentioned first embodiment, it is possible to further reduce the perception quantity of the dynamic false contour by utilizing a pair of series.

Second Embodiment

Figure 9:
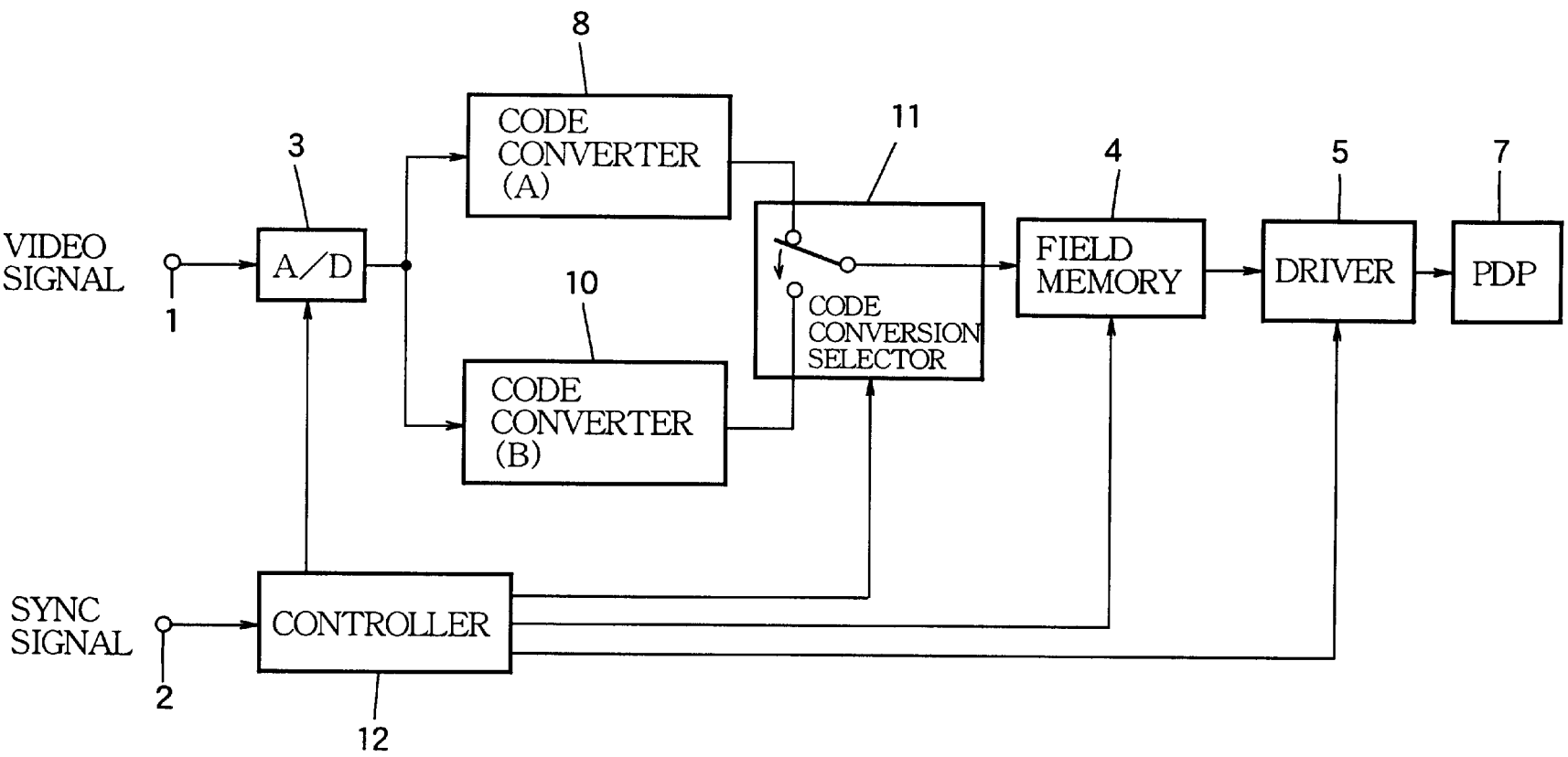
FIG. 9 is a diagram showing the configuration of a display apparatus according to a second embodiment of the present invention.

FIG. 9 is a block diagram showing the configuration of a display apparatus according to a second embodiment of the present invention, which realizes a gradation display method. Those structures in the figures used for the display apparatus of the second embodiment that are identical or corresponding to structures in the above-mentioned display apparatus shown in FIG. 1 are assigned identical symbols.

In the figure, 1 denotes an input terminal to which a video signal is input; 2 denotes another input terminal to which sync signals are input; 3 denotes an A/D converter which converts the video signal applied to the input terminal 1 into a digital signal; 9 denotes a code converter (A) which converts the output of the A/D converter 3 into the coded signal in accordance with one of the pair of series; 10 denotes a code converter (B) which converts the output of the A/D converter 3 into the coded signal in accordance with the other of the pair of series; 11 denotes a code conversion selector which selects either output from the code converter 8 or code converter 10 in accordance with an output signal from a controller 12; 4 denotes a field memory which stores an output signal from the code converter 8 which corresponds to two fields; 5 denotes a driver which drives a PDP 7 in accordance with an output signal from the code conversion selector 11 and the controller 12; 7 is the PDP; and 12 denotes the controller which operates to control the A/D converter 3, the code conversion selector 11, the field memory 4, and the driver 5 on the basis of the sync signals.

The operation of the display apparatus having the above-mentioned configuration will be described below, with an emphasis on a difference between the first and second embodiments.

The code converter (A) 9 converts the output signal from the A/D converter 3 in accordance with, for example, the series (series A) shown in FIG. 3 in the similar manner as the code converter 8 shown in the first embodiment does. On the other hand, the code converter (B) 10 performs a code conversion on the basis of the series B, in which the up-shift to the higher significance bit occurs at a different gray level from the series A, in accordance with the up-shift rule.

The code conversion selector 11 switches between output signals from the pair of code converters 8 and 10 every H (which is an integer not less than 1) picture elements in the horizontal direction across the screen, and every V (which is an integer not less than 1) picture elements in the vertical direction across the screen. Further, the code conversion selector 11 may switch between output signals from the pair of code converters 9 and 10 the first and second series every H picture elements, every V picture elements, and every F (which is an integer not less than 1) fields in time. In other respects, the operation is the same as the operation of the first embodiment.

Figure 10:
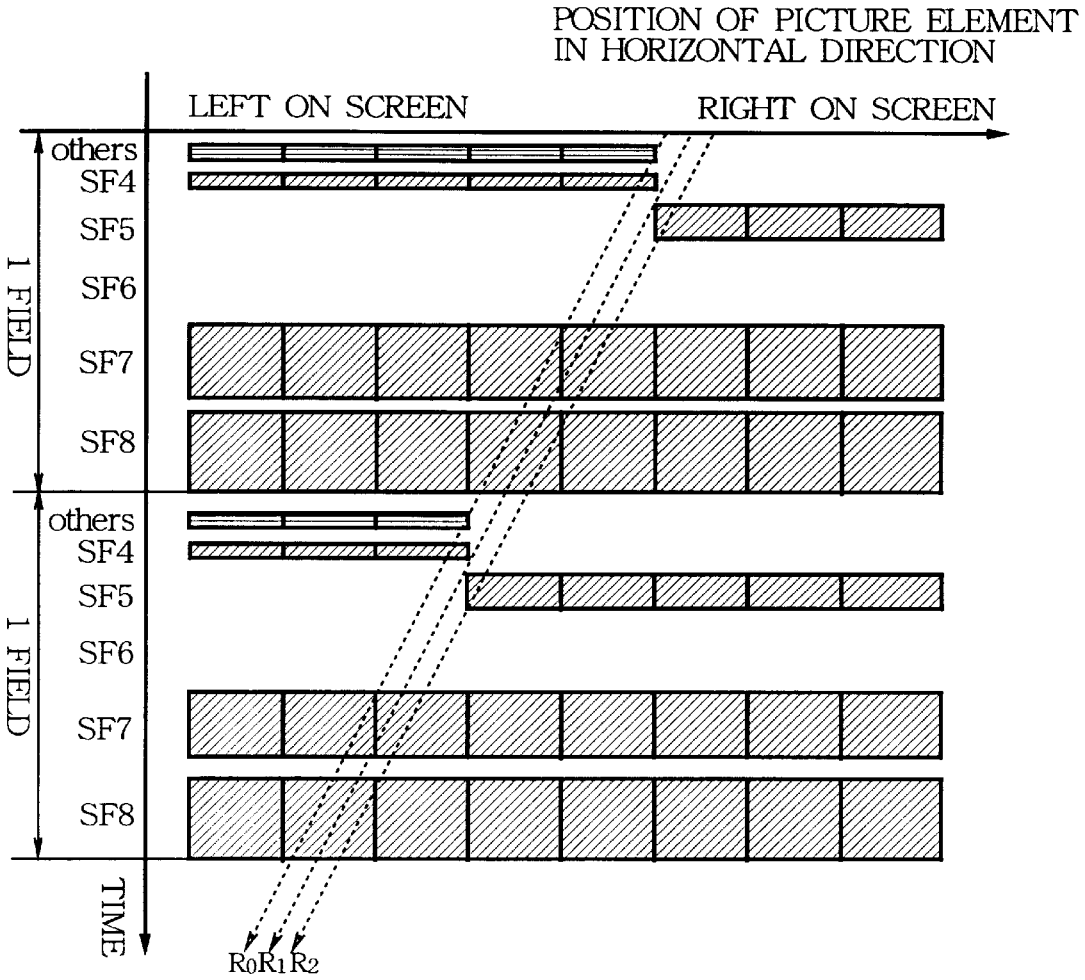
FIG. 10 is a diagram for explaining a phenomenon of a dynamic false contour when a series B is used in the display apparatus according to the second embodiment of the present invention.

FIG. 10 is a diagram illustrating the display condition in accordance with the series B for the same image and gray level as those in FIG. 4 which is described before in connection with the first embodiment.

Figure 11:
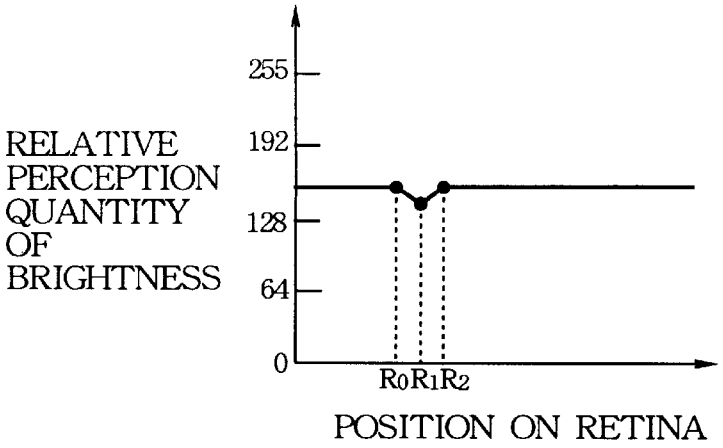
FIG. 11 is a diagram for explaining the perception quantity of the dynamic false contour picture when the series B is used in the display apparatus according to the second embodiment of the present invention.

As mentioned previously, a gray level in the series B at which an up-shift to a higher significance bit occurs, is different from a gray level in the series A at which an up-shift to a higher significance bit occurs. As shown in FIG. 10, in the series B, when the gray level is changed from 175 to 176, a sub-field SF8 having a highest relative ratio of brightness and a sub-field SF7 having a second highest relative ratio of brightness do not change their display condition, and change in the display condition occurs for sub-fields (for example, SF4 and SF5) of lower relative ratio of brightness. Accordingly, when such an image is viewed by a human being, the line of vision will be roughly placed on the broken lines $R_0$, $R_1$ and $R_2$. It will be noted from graphical illustration in FIG. 11 that the perception quantity of the false contour at positions on the retina which corresponds to the broken lines $R_0$, $R_1$ and $R_2$ is reduced as compared with the perception quantity achieved with the series A.

Figure 12:
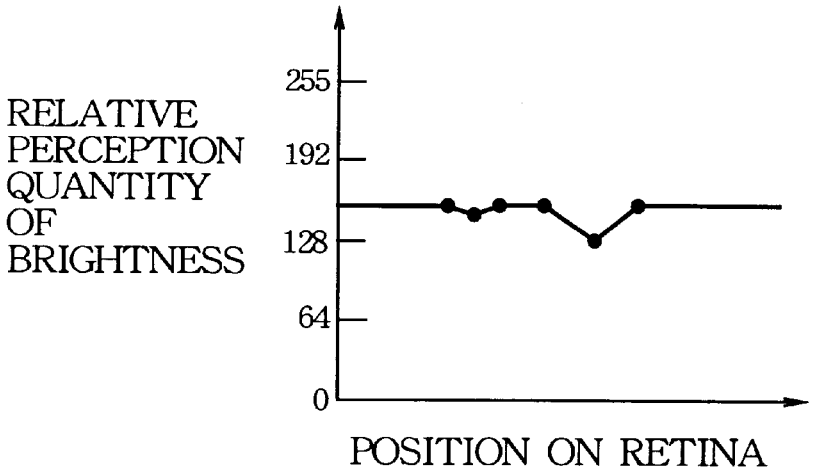
FIG. 12 is a diagram for explaining the effect of reducing the dynamic false contour when series A and B are used in the display apparatus according to the second embodiment of the present invention.
Figure 13:
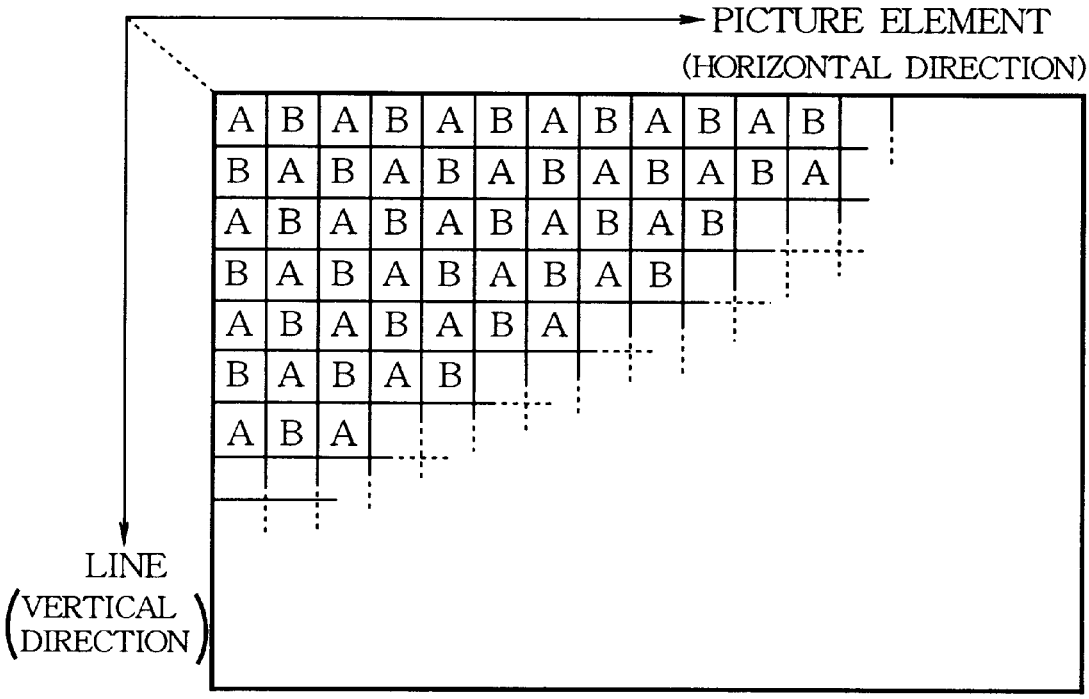
FIG. 13 is a diagram for explaining a manner of switching between the pair of series A and B in the display apparatus according to the second embodiment of the present invention.

In particular, when the pair of series A and B are switched at a relatively close pitch such as every picture element in the horizontal direction and every picture element in the vertical direction, as shown in FIG. 13, the integrating effect of human vision in the spatial dimensions averages out dynamic false contour as perceived in each of the series A and B, in a manner illustrated in FIG. 12. When this is compared with FIG. 5, it will be evident that the dynamic false contour is further reduced than when a single series is used.

Third Embodiment

In the third embodiment, gray levels at which an up-shift occurs are chosen to establish a special relationship between a pair of series, thereby allowing a further reduction in the perception quantity of a dynamic false contour.

Figure 14A:
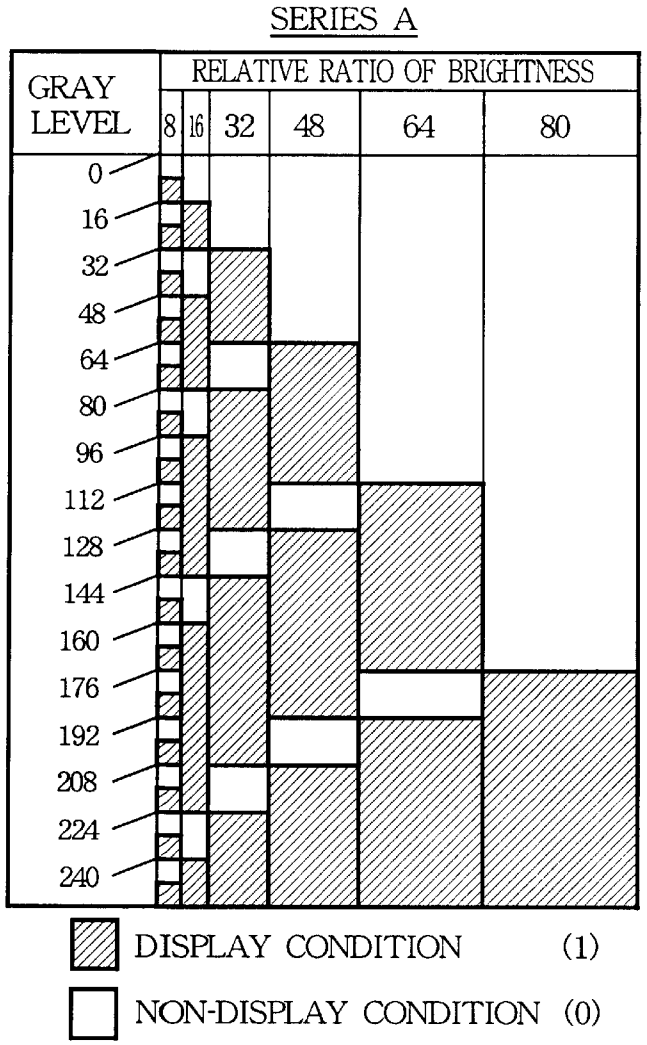
FIGS. 14A and 14B are diagrams showing examples of the pair of series A and B which are to be used in a display apparatus according to a third embodiment of the present invention.
Figure 14B:
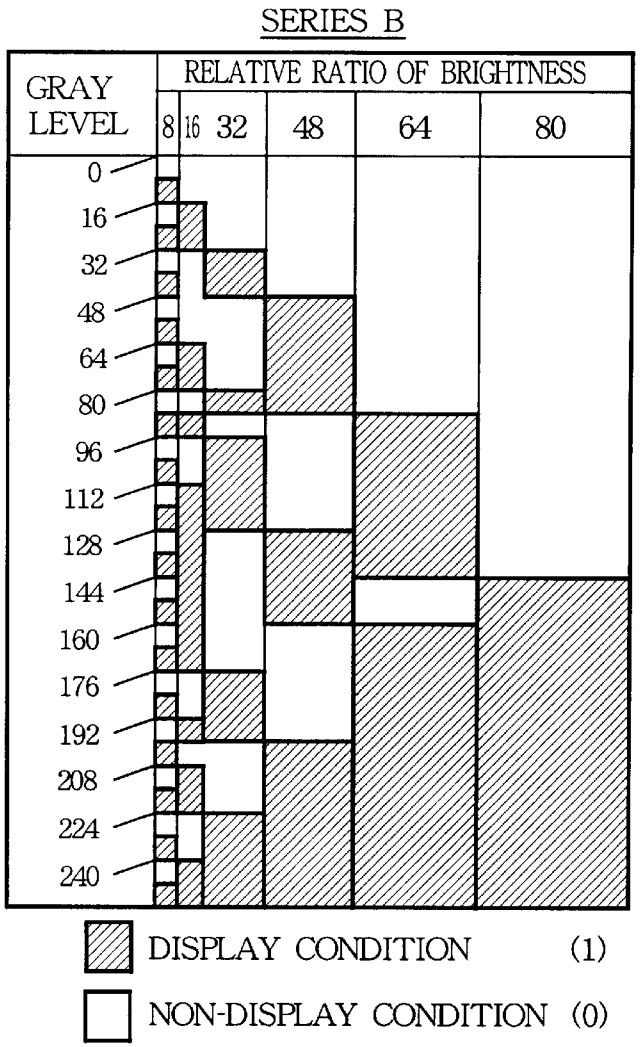

FIGS. 14A and 14B are diagrams representing series A and B according to the third embodiment, respectively.

When gray levels at which an up-shift occurs for the series A and B are chosen as illustrated in FIGS. 14A and 14B, a dynamic false contour can be more effectively reduced.

Specifically, a gray level (for example, gray level 64 or 112 in FIG. 14A), at which an up-shift in the series A to the bit bbx (for example, a relative ratio 48 or 64 in FIG. 14A) occurs, is between a gray level (for example, a gray level 48 or 88 in FIG. 14B), at which an up-shift in the series B to the bit bbx (for example, a relative ratio 48 or 64 in FIG. 14B) having a relatively high weight, even though the weight is not highest, and a gray level (for example, a gray level 88 or 144 in FIG. 14B), at which an up-shift in the series B to the bit bby (for example, a relative ratio 64 or 80 in FIG. 14B) having a next higher significance than the bit bbx (for example, a relative ratio 48 or 64 in FIG. 14B).

Further, a gray level (for example, a gray level 176 in FIG. 14A), at which an up-shift in the series A to the bit bbz (for example, a relative ratio 80 in FIG. 14A) having the highest weight occurs, is between a gray level (for example, a gray level 144 in FIG. 14B), at which an up-shift in the series B to the bit bbz (for example, a relative ratio 80 in FIG. 14B) having the highest weight and a highest gray level (for example, a gray level 255 in FIG. 14B).

The described choice enables a gray level at which a false contour occurs in the series A to be kept away from a gray level at which a false contour occurs in the series B as far as possible. Accordingly, at a gray level where a false contour occurs in one of the series, the occurrence of a false contour in the other series can be suppressed, thus more effectively allowing the false contour to be reduced.

Fourth Embodiment

The use of a pair of series A and B has been described in connection with the second and third embodiments. However, the number of series used need not be limited to two, but a similar effect as described above in connection with the second and third embodiments can be achieved when three or more series are used.

Figure 15:
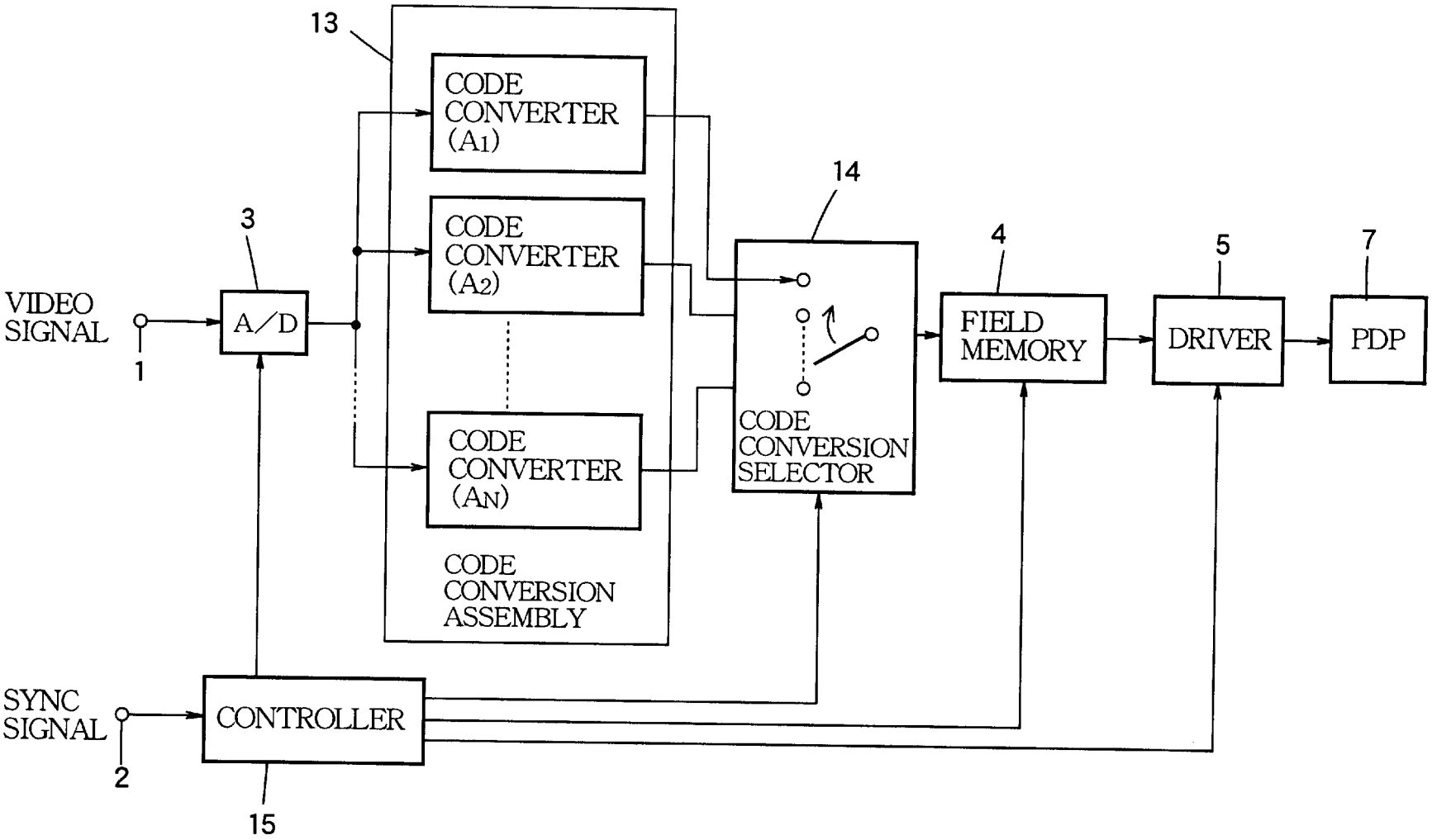
FIG. 15 is a block diagram showing the configuration of a display apparatus according to a fourth embodiment of the present invention.

FIG. 15 is a block diagram showing the configuration of a display apparatus according to a fourth embodiment of the present invention, which realizes a gradation display method. Those structures in the figures used for the description of the display apparatus of the fourth embodiment that are identical or corresponding to structures in the above-mentioned display apparatus shown in FIG. 9 are assigned identical symbols.

As shown in FIG. 15, a video signal is input to an input terminal 1, and sync signals are input to an input terminal 2. An A/D converter 3 converts the input video signal into a digital signal to feed a code conversion assembly 13 which includes a plurality of code converters A1 to AN which operate to perform a code conversion of the output from the A/D converter 3 in accordance with a plurality of series. A code conversion selector 14 selects one of outputs from the code converters A1 to AN for output in accordance with an output signal supplied from a controller 15. As before, a field memory 4 stores two fields of an output signal from the code conversion selector 14. As before, a driver 5 is fed from the field memory to drive a PDP 7 in accordance with an output signal from the controller 15. The controller 15 controls the A/D converter 3, the code conversion assembly 13, the field memory 4 and the driver 5 on the basis of the sync signals.

In the fourth embodiment, in order to realize a gradation display method, one of code converters A1 to AN, which correspond to a plurality of series having different gray levels at which the up-shift occurs is selected, and an output signal from the code conversion assembly 13 may be switched by the code conversion selector 14.

When one of the series identified by the code converters A1 to AN is selected, at a gray level where a false contour occurs in a certain series, the occurrence of a false contour in another or other series can be suppressed, thus more effectively reducing the occurrence of a false contour.

Fifth Embodiment

In the first to fourth embodiments mentioned above, the luminescence sequence uses the relative ratio including 1, 2, 4, 8, 16, 32, 48, 64 and 80. However, the relative ratio of brightness is not limited thereto. A series which includes at least one sub-field having a relative ratio of brightness which deviates from a power series of 2 and which complies with the up-shift rule may be used, thereby reducing a false contour.

Sixth Embodiment

An effect of reducing a dynamic false contour in the same manner as described above in connection with the second and third embodiments can also be achieved by superimposing a different offset level upon a video signal every H picture elements (where H is an integer not less than 1) in the horizontal direction across the screen, every V picture elements (where V is an integer not less than 1) in the vertical direction of the screen, and every F fields (where F is an integer not less than 1) in time axis direction.

Figure 16:
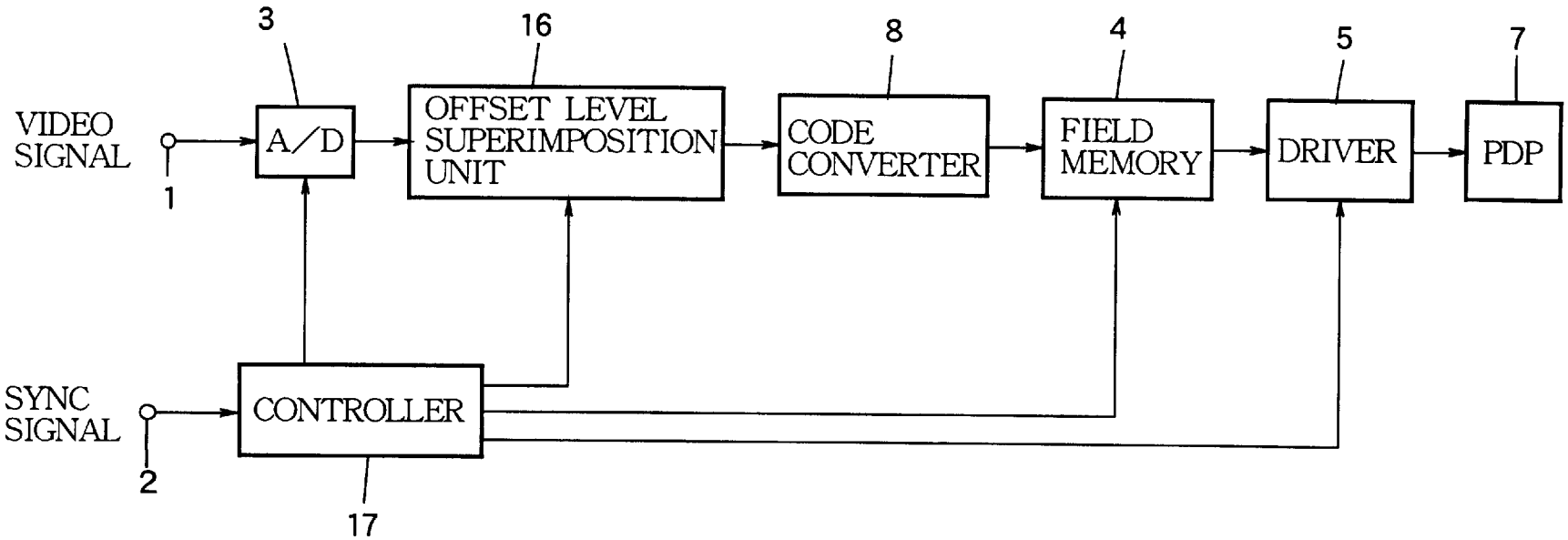
FIG. 16 is a block diagram showing the configuration of a display apparatus according to a sixth embodiment of the present invention.

FIG. 16 is a block diagram showing the configuration of a display apparatus according to a sixth embodiment of the present invention, which realizes a gradation display method. In the description of the sixth embodiment, those structures in the sixth embodiment that are identical or corresponding to structures in FIG. 1 are assigned identical symbols, without repeating the description.

As shown in FIG. 16, a video signal is input to an input terminal 1, while sync signals are input to an input terminal 2. An A/D converter 3 converts the input video signal into a digital signal and feeds an offset level superimposition unit 16 which operates to superimpose a different offset level upon the output signal from the A/D converter 3 every H picture elements in the horizontal direction and every V picture elements in the vertical direction of the screen and every F fields in time axis direction. A code converter 8 converts an output from the offset level superimposition unit 16. A field memory 4 stores two fields of an output signal from the code converter 8, and feeds a driver 5 which in turn drives a PDP 7 in accordance with an output signal from a controller 17. The controller 17 controls the A/D converter 3, the offset level superimposition unit 16, the field memory 4 and the driver 5 on the basis of the sync signals.

Thus, in the sixth embodiment, the offset level superimposition unit 16 is interposed between the A/D converter 3 and the code converter 8.

Figure 17:
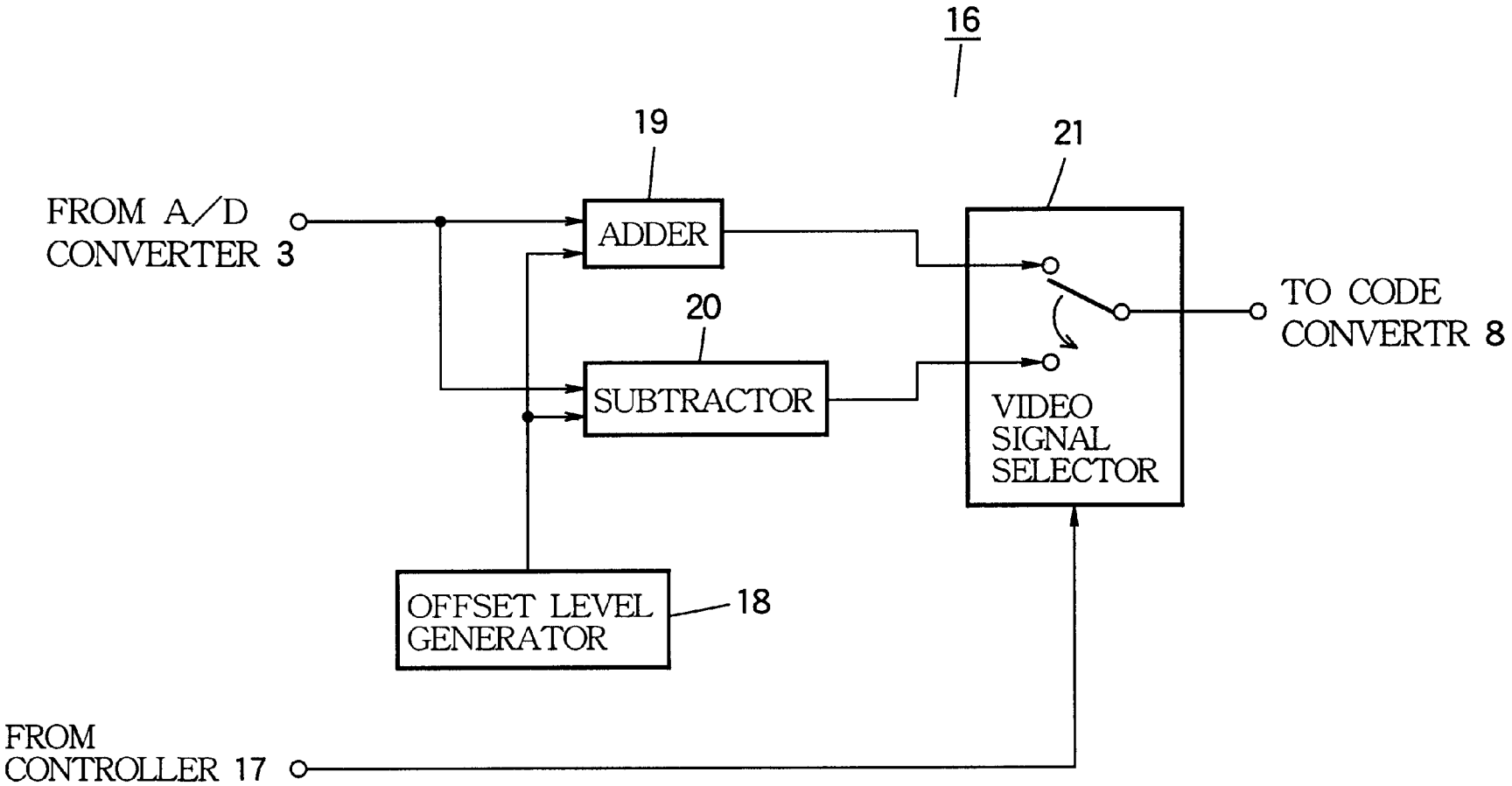
FIG. 17 is a block diagram showing the configuration of an offset level superimposition unit shown in FIG. 16.

FIG. 17 is a block diagram showing the configuration of the offset level superimposition unit 16.

As shown in FIG. 17, the offset level superimposition unit 16 has an offset level generator 18 which generates a given offset level, an adder 19 which adds an offset level generated to the digital video signal, a subtractor 20 which subtracts the generated offset level from the digital video signal, and a video signal selector 21 which selects either output from the adder 19 or the subtractor 20 in accordance with an output signal from the controller 17.

The operation of the offset level superimposition unit 16 will be described more specifically with reference to FIG. 17.

The superimposition unit 16 operates to add a given offset level which is generated by the offset level generator 18, or subtract it from, the video signal which is converted into a digital signal by the A/D converter 3 in the adder 19 and the subtractor 20, respectively.

The video signal selector 21 switches between the video signals to which the offset level is added or from which the offset level is subtracted every H picture elements in the horizontal direction, every V picture elements in the vertical direction and every F fields in time axis direction for output to the code converter 8. Subsequent operation takes place in the same manner as described above in connection with the first embodiment.

The reason that the effect of reducing the perception quantity of a false contour is obtained when a given offset level is superimposed upon a video signal will be described below.

Figure 18:
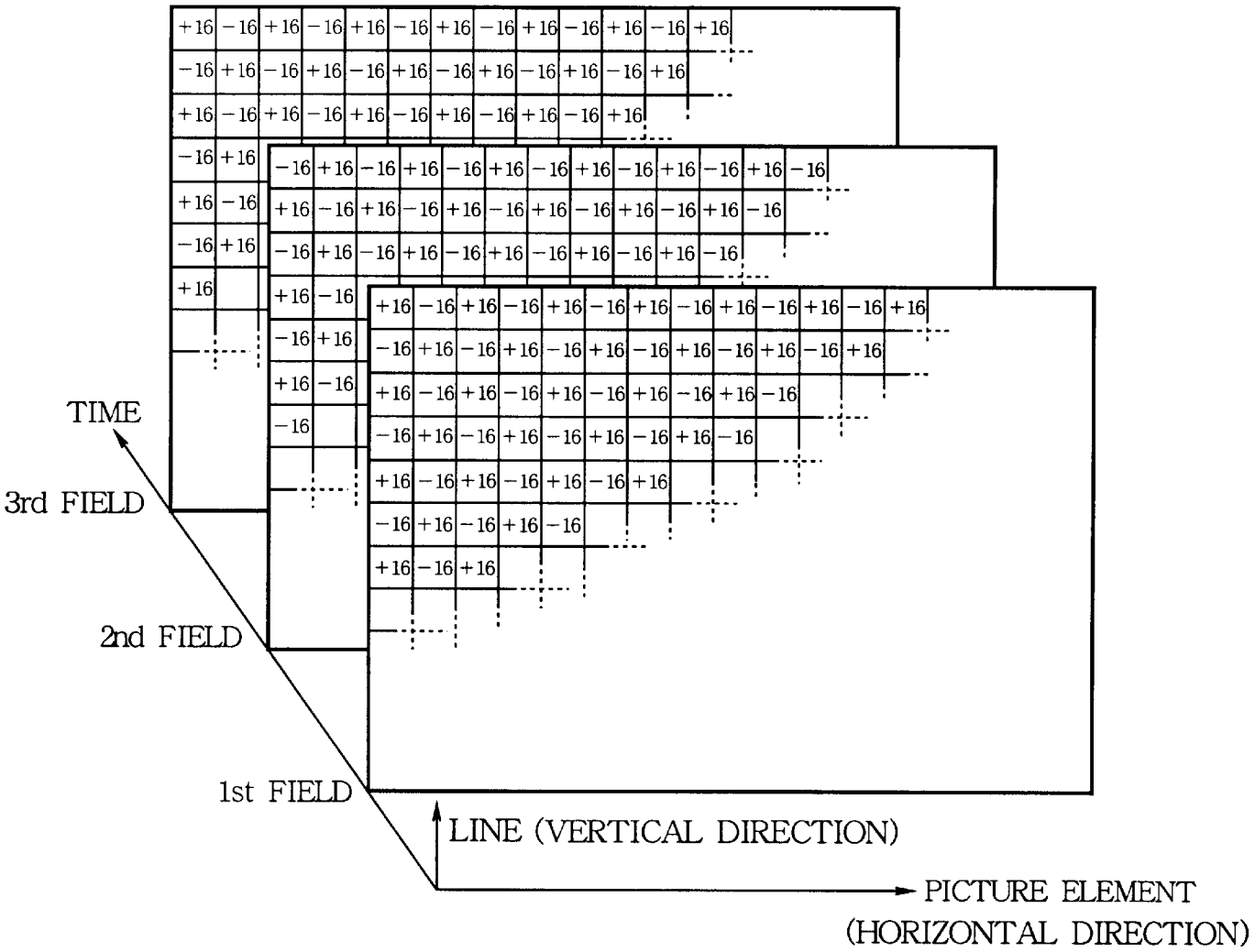
FIG. 18 is a diagram for explaining a manner of switching between the offset levels +16 and −16 on the screen of the display apparatus according to the sixth embodiment.

FIG. 18 is a diagram for explaining positions on the screen at which the offset level +16 or −16 is superimposed on the series, wherein the sign, either positive or negative, of the offset level +16 or −16 is switched every picture element in the horizontal direction, every picture element in the vertical direction and every field in time axis direction.

Figure 19:
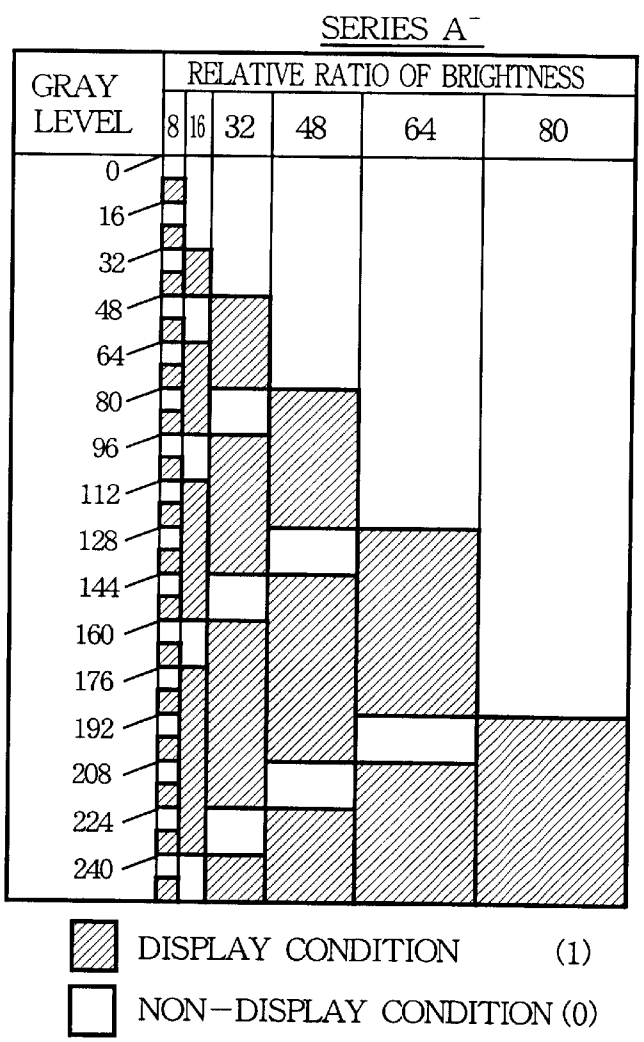
FIG. 19 is a diagram showing two equivalent series $A^+$ and $A^-$ when the example shown in FIG. 18 is used.
Figure 19:
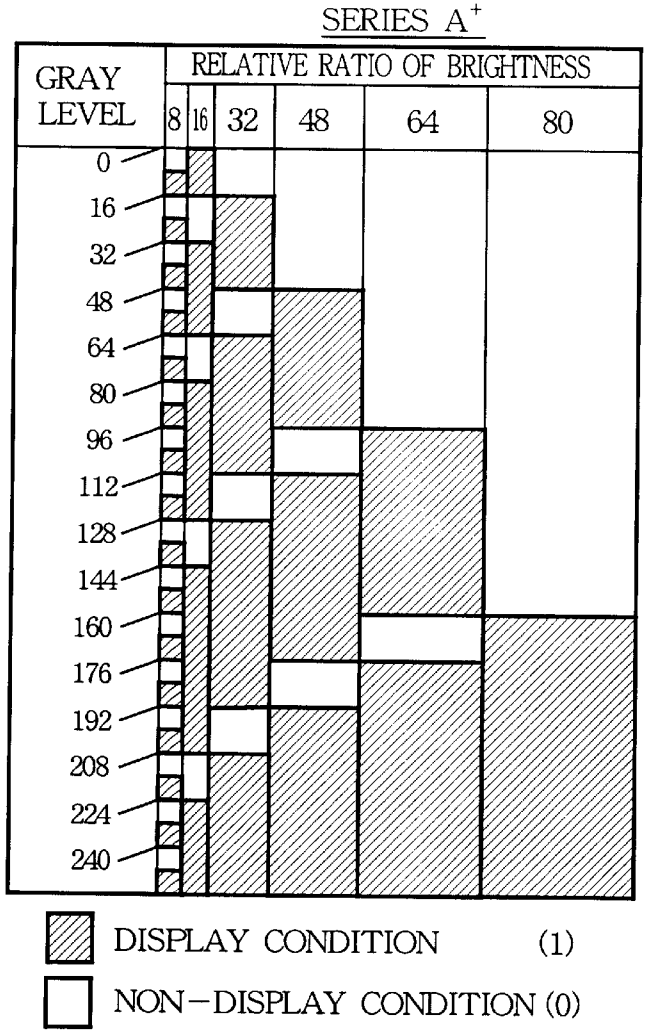
Figure 20:
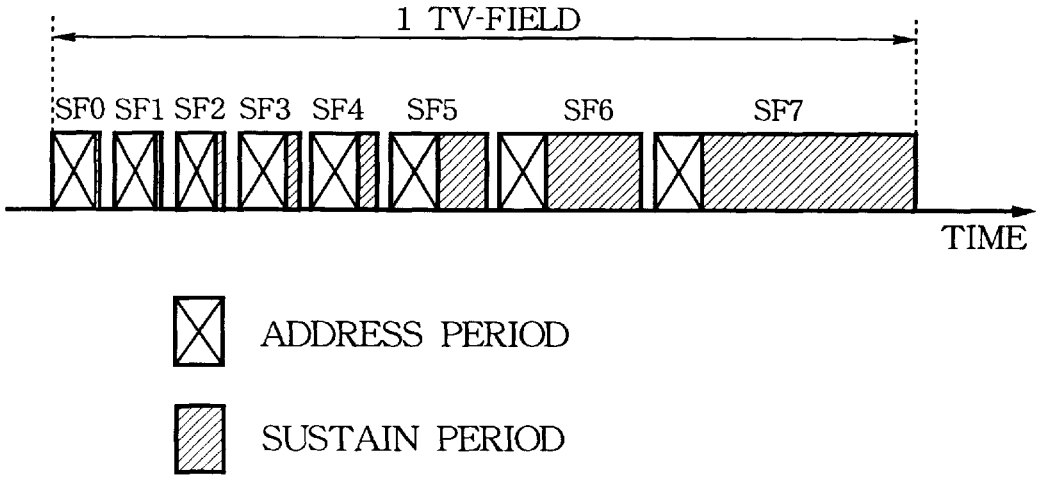
FIG.20 PRIOR ART
FIG. 20 is a diagram showing a luminescence sequence used for explaining in a prior art display apparatus.

When the series A described above in connection with the first embodiment is used in the code converter 8, the video signal is apparently converted, by the combination of the offset level superimposition unit 16 and the code converter 8, as if a pair of series $A^+$ and $A^-$ as shown in FIG. 19 are used. The series $A^+$ is the superimposed series obtained by superimposing the offset level +16 on the series A, while the series $A^-$ is the superimposed series obtained by superimposing the offset level −16 on the series A. The pair of series $A^+$ and $A^-$ have a relationship therebetween which is similar to the up-shift mentioned previously in connection with the second embodiment.

Since the pair of series which are related in this manner have different gray levels at which an up-shift occurs, it follows that at the gray level where a false contour occurs in a series $A^+$, the occurrence of a false contour in the series $A^-$ is greatly reduced while a gray level where a false contour occurs in the series $A^-$, the occurrence of the false contour in the series $A^+$ is greatly reduced. Accordingly, when a switching between the series is made across the screen, the integrating effect of the human vision in the spatial dimensions averages out the perception quantity of the false contour, whereby there is obtained an effect of reducing the false contour in the similar manner as mentioned above in connection with the second embodiment.

It is to be noted that the superimposed offset level is also averaged out by the integrating effect of the human vision in the spatial dimensions and in time, and thus is eliminated from perception.

While a single series is used in the code converter 8 in the above description, a plurality of series, as illustrated in the second to the fourth embodiment, may be used in the code converter 8.

Also, in the above description, the luminescence sequence utilized the relative ratio comprising 1, 2, 4, 8, 16, 32, 48, 64 and 80, but the relative ratio is not limited thereto, and the luminescence sequence as described above in connection with the fifth embodiment may also be used.

In each embodiment described above, the display apparatus comprises a PDP system, but it should be understood that invention is applicable to any display which is capable of representing a gray scale images by dividing one field into a plurality of sub-fields.

Finally, components which constitute the display apparatus such as a code converter, a field memory, an offset level superimposition unit, for example, are not limited to the specific variety or to any specific connection as described.

What is claimed is:

1. A display apparatus, in which a field, comprising a digital signal, is divided into a plurality of sub-fields, each one of the plurality of sub-fields corresponding to a bit, having different relative ratios of luminescent time and each one of the plurality of sub-fields indicating either a state of luminescence or non-luminescence for displaying gray scale images, comprising:

code conversion means for converting a video signal into a coded signal comprised of a plurality of bits, each bit indicating a state of luminescence or non-luminescence in the respective sub-fields, the plurality of sub-fields including at least one sub-field having a relative ratio of luminescent time which deviates from a power series of 2;

wherein the plurality of sub-fields having a high relative ratio of luminescent time are arranged in a time sequence in a descending or ascending order, the high relative ratio of luminescent time including at least the highest, the second highest and the third highest relative ratios of luminescent time; and wherein, when an up-shift occurs in a circumstance that at a gray level of n which is an integer not less than 0, a first sub-field having the high relative ratio of luminescent time indicates a state of luminescence while a second sub-field having a next higher relative ratio of luminescent time than the first sub-field indicates a state of non-luminescence, and at a gray level of n+1, the second sub-field indicates a state of luminescence, the first sub-field indicates a state of non-luminescence at the gray level of n+1.

2. The display apparatus of claim 1, wherein said code conversion means includes:

a plurality of code converters each having a different series of codes which indicates a combination of luminescence and non-luminescence in the plurality of sub-fields in the respective gray levels, the series each including a different gray level at which the up-shift occurs; and a selector for selecting one of the code converters, thereby switching the series used when converting the video signal into the coded signal.

3. The display apparatus of claim 1, wherein said code conversion means includes:

a first code converter having a first series which indicates a first combination of luminescence and non-luminescence in the plurality of sub-fields in the respective gray levels;

a second code converter having a second series which indicates a second combination of luminescence and non-luminescence in the plurality of sub-fields in the respective gray levels, a gray level of the first code converter at which the up-shift in the first series occurs being different from a gray level of the second code converter at which the up-shift in the second series occurs; and a selector for selecting one of the first and second code converters, thereby switching the first and second series every H picture elements in a horizontal direction across a screen, where H in an integer not less than 1, and every V picture elements in a vertical direction across the screen, where V is an integer not less than 1.

4. The display apparatus of claim 3, wherein said selector further switches the first and second series every F fields in a time axis direction, where F is an integer not less than 1.

5. The display apparatus of claim 3, wherein, if the gray level at which the up-shift occurs in the second code converter to turn on the sub-field S1 having a high relative ratio of luminescent time, which is not the highest relative ratio of luminescent time, is one gray level, and if the gray level at which the up-shift occurs in the second code converter to turn on the sub-field S2 having a high relative ratio of luminescent time next to S1 is another gray level, then the gray level at which the up-shift occurs in the first code converter to turn on the sub-field S2 is set between the one gray level and the another gray level; and in addition, if the gray level at which the up-shift occurs in the second code converter to turn on the sub-field S3 having the highest relative ration of luminescent time is given, then the gray level at which the up-shift occurs in the first code converter to turn on the sub-field S3 is set between the gray level at which the up-shift occurs in the second code converter to turn on the sub-field and the highest gray level.

6. The display apparatus of claim 4, wherein, if the gray level at which the up-shift occurs in the second code converter to turn on the sub-field S1 having a high relative ratio of luminescent time, which is not the highest relative ratio of luminescent time, is one gray level, and if the gray level at which the up-shift occurs in the second code converter to turn on the sub-field S2 having a high relative ration of luminescent time next to S1 is another gray level, then the gray level at which the up-shift occurs in the first code converter t turn on the sub-field S2 is set between the one gray level and the another gray level; and in addition, if the gray level at which the up-shift occurs in the second code converter to turn on the sub-field S3 having the highest relative ratio of luminescent time is given, then the gray level at which the up-shift occurs in the first code converter to turn on the sub-field S3 is set between the gray level at which the up-shift occurs in the second code converter to turn on the sub-field and the highest gray level.

7. The display apparatus of claim 1, further comprising:

an offset level superimposition means for superimposing a different offset level upon the video signal to be displayed every H picture elements in a horizontal direction across a screen, where H is an integer not less than 1, every V picture elements in a vertical direction across the screen, where V is an integer not less than 1, and every F fields in a time axis direction, where F is an integer not less than 1.

* * * * *